US012070086B2

(12) United States Patent
Takii et al.

(10) Patent No.: US 12,070,086 B2
(45) Date of Patent: Aug. 27, 2024

(54) BRASSIERE AND CLOTHES

(71) Applicant: ASICS Corporation, Hyogo (JP)

(72) Inventors: Yasuho Takii, Hyogo (JP); Hiroto Mori, Hyogo (JP); Nanako Sumi, Hyogo (JP); Yuka Matsushima, Hyogo (JP)

(73) Assignee: ASICS Corporation, Hyogo (JP)

( * ) Notice: Subject to any disclaimer, the term of this patent is extended or adjusted under 35 U.S.C. 154(b) by 824 days.

(21) Appl. No.: 16/953,086

(22) Filed: Nov. 19, 2020

(65) Prior Publication Data

US 2021/0068474 A1 Mar. 11, 2021

Related U.S. Application Data

(63) Continuation of application No. PCT/JP2018/019529, filed on May 21, 2018.

(51) Int. Cl.
*A41C 3/00* (2006.01)

(52) U.S. Cl.
CPC ..... *A41C 3/0057* (2013.01)

(58) Field of Classification Search
CPC ..... A41C 1/02; A41C 3/0057; A41C 3/0085
USPC ..... 450/75
See application file for complete search history.

(56) References Cited

U.S. PATENT DOCUMENTS

| | | | | |
|---|---|---|---|---|
| 4,311,150 | A | 1/1982 | Schreiber et al. | |
| 4,444,192 | A | 4/1984 | Stern et al. | |
| 4,655,224 | A | 4/1987 | Stern et al. | |
| 11,696,606 | B2 * | 7/2023 | Inselberg | A41C 3/0085 450/39 |
| 2012/0115852 | A1 * | 5/2012 | Schultz | A61P 35/02 544/360 |
| 2016/0360801 | A1 * | 12/2016 | Sze | A41D 31/185 |
| 2017/0290376 | A1 | 10/2017 | Maheshwari et al. | |
| 2017/0360118 | A1 * | 12/2017 | Randall | A41C 3/02 |

FOREIGN PATENT DOCUMENTS

| | | | |
|---|---|---|---|
| CN | 1764533 | A | 4/2006 |
| CN | 207100538 | U | 3/2018 |
| JP | H10251904 | A | 9/1998 |
| JP | H10292209 | A | 11/1998 |
| JP | 2002-138307 | A | 5/2002 |
| JP | 2013-49939 | A | 3/2013 |
| JP | 2017031513 | | 2/2017 |
| JP | 2017145541 | | 8/2017 |

(Continued)

OTHER PUBLICATIONS

Chinese Office Action issued in corresponding Chinese Patent Application No. 201880093620.0, dated Mar. 30, 2022, with English translation.

(Continued)

*Primary Examiner* — Timothy K Trieu
(74) *Attorney, Agent, or Firm* — Rimon P.C.

(57) ABSTRACT

The brassiere includes the breast support portion arranged at the chest of the wearer, the belt portion arranged from the lower side of the breast support portion to the back portion, and the body-side support portion connected to the lateral end of the breast support portion and arranged from the body side to the back portion. The stretching property of the body-side support portion in the lengthwise direction is higher than that in the circumferential direction.

13 Claims, 38 Drawing Sheets

(56) References Cited

FOREIGN PATENT DOCUMENTS

| | | | |
|---|---|---|---|
| WO | 93/10678 | A1 | 6/1993 |
| WO | 94/23601 | A1 | 10/1994 |
| WO | 2008093435 | A1 | 8/2008 |

OTHER PUBLICATIONS

Extended European Search Report issued in corresponding European Patent Application No. 18919516.7, dated Apr. 14, 2022.
International Preliminary Report on Patentability issued in corresponding International Patent Application No. PCT/JP2018/019529, dated Nov. 24, 2020, with English translation.
International Search Report issued in corresponding International Patent Application No. PCT/JP2018/019529, dated Jul. 3, 2018, with English translation.
Japanese Office Action issued in corresponding Japanese Patent Application No. 2019-542744, dated Oct. 1, 2019, with English translation.
Partial Supplementary European Search Report issued in corresponding European Patent Application No. 18919516.7, dated Jan. 12, 2022.
Office Action issued in the corresponding European patent Application No. 18919516.7 dated Apr. 8, 2024.

* cited by examiner

FIG.6

| PART | KNITTED TISSUE | STRETCHING PROPERTY IN LENGTHWISE DIRECTION | STRETCHING PROPERTY IN CIRCUMFERENTIAL DIRECTION |
|---|---|---|---|
| BREAST SUPPORT PORTION | OVERLAPPING OF KNITTED TISSUE B AND C | 2 | 2 |
| BELT PORTION | OVERLAPPING OF KNITTED TISSUE A | 1 (LOW) | 1 (LOW) |
| BODY-SIDE SUPPORT PORTION LOWER SUPPORT PORTION | KNITTED TISSUE B | 3 | 4 |
| BODY-SIDE SUPPORT PORTION UPPER SUPPORT PORTION | KNITTED TISSUE D | 5 (HIGH) | 3 |
| BACK SUPPORT PORTION | KNITTED TISSUE B | 3 | 4 |
| SHOULDER STRAP PORTION | KNITTED TISSUE C | 4 | 5 (HIGH) |

BRASSIERE AND CLOTHES

CROSS-REFERENCE TO RELATED APPLICATION

This application is a continuation of International Patent Application No. PCT/JP2018/019529, filed on May 21, 2018, the entire contents of which are incorporated herein by reference.

BACKGROUND OF THE INVENTION

1. Field of the Invention

The present invention relates to a brassiere and clothes.

2. Description of the Related Art

A brassiere is put on a wearer's chest, covers and protects her breasts, and appropriately holds her breasts to support her movement.

For example, Publication of US patent application No. US 2016/0360801 A discloses a brassiere including at least a first layer of fabric forming a breast cup portion, an upper support portion located above the breast cup portion, and a lower support portion located below the breast cup portion. The brassiere includes a first plurality of openings in the upper support portion and a second plurality of openings in the lower support portion to have breathability and flexibility.

SUMMARY OF THE INVENTION

Although the brassiere disclosed in Publication of US patent application No. US 2016/0360801 A has breathability and flexibility in the upper support portion and the lower support portion, a wearer's body is not considered. For example, when the wearer performs an arm raising movement, her skin in the chest on the body side under the armpit significantly stretches. The brassiere generates appropriate wearing compression to the chest to provide feeling of wearing. However, in a case in which the brassiere does not follow stretch and contraction of the skin on the body side, this causes problems in which the brassiere inhibits the movement of the skin on the body side to disturb exercise, and in which displacement of the brassiere from the skin is generated.

The present invention is accomplished by taking such problems as mentioned above into consideration thereof, and an object thereof is to provide a brassiere enabling inhibition of stretch of a wearer's skin on the body side to be reduced when the wearer performs an arm raising movement.

An aspect of the present invention is a brassiere. A brassiere includes a breast support portion arranged at a chest of a wearer, a belt portion arranged from a lower side of the breast support portion to a back portion, and a body-side support portion connected to a lateral end of the breast support portion and arranged from a body side to the back portion. A stretching property of the body-side support portion in a lengthwise direction is higher than that in a circumferential direction.

Also, a brassiere according to another aspect includes a breast support portion arranged at a chest of a wearer, a belt portion arranged from a lower side of the breast support portion to a back portion, and a body-side support portion connected to a lateral end of the breast support portion and arranged from a body side to the back portion. At least a part of the lateral end of the breast support portion is formed inside a verge line, and the body-side support portion is provided to a verge line lower side. A stretching property of the body-side support portion in a lengthwise direction is higher than that of the breast support portion.

Note that arbitrary combination of the above components, and mutual substitution of the components and expressions of the present invention among a method, an apparatus, and the like are valid as aspects of the present invention.

BRIEF DESCRIPTION OF THE DRAWINGS

Embodiments will now be described by way of examples only, with reference to the accompanying drawings which are meant to be exemplary, not limiting and wherein like elements are numbered alike in several Figures in which:

FIG. 6 is a table illustrating the knitted tissues and levels of the stretching properties corresponding to the respective portions.

FIGS. 12A, 12B 12C and 12D are schematic views describing a verge line L and the like.

DETAILED DESCRIPTION OF THE INVENTION

Figure 1:
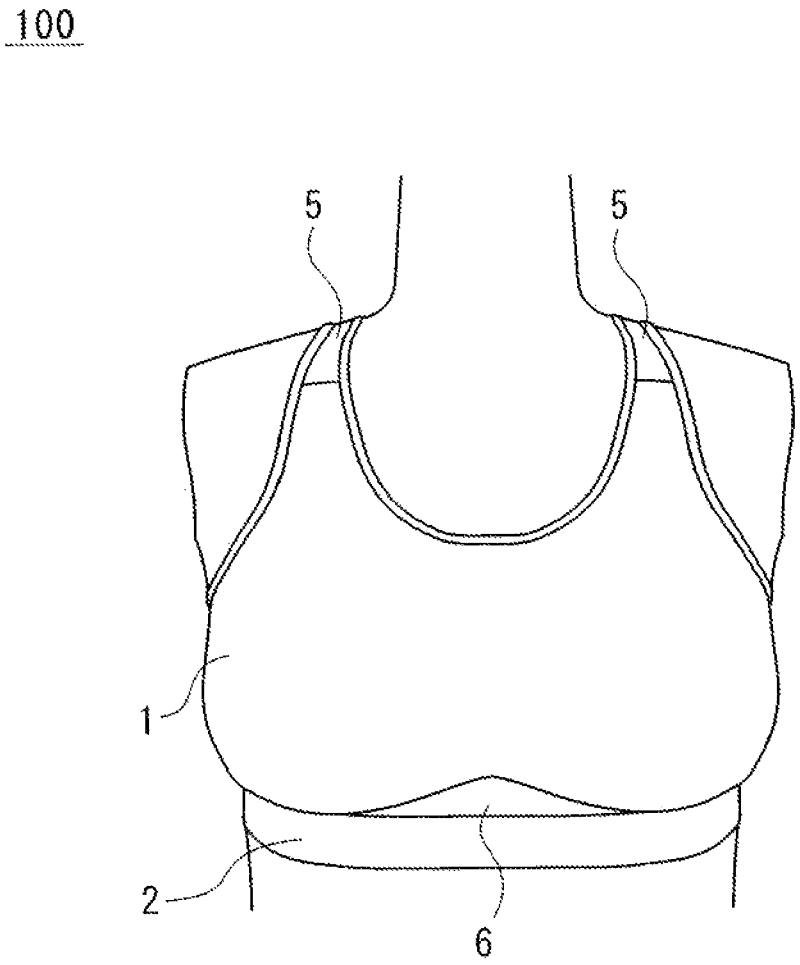
FIG. 1 is a front view illustrating a brassiere according to a first embodiment.

The invention will now be described by reference to the preferred embodiments. This does not intend to limit the scope of the present invention, but to exemplify the invention.

Hereinbelow, the present invention will be described based on preferred embodiments with reference to FIGS. 1 to 39. Similar or identical components and members illustrated in the respective figures are labeled with the same reference numerals, and description of the duplicate components is omitted as needed. Also, a dimension of a member in each figure is enlarged or shrunk as needed to facilitate understanding. Also, some members that are not important to describe the embodiment in each figure are omitted.

First Embodiment

Figure 2A:
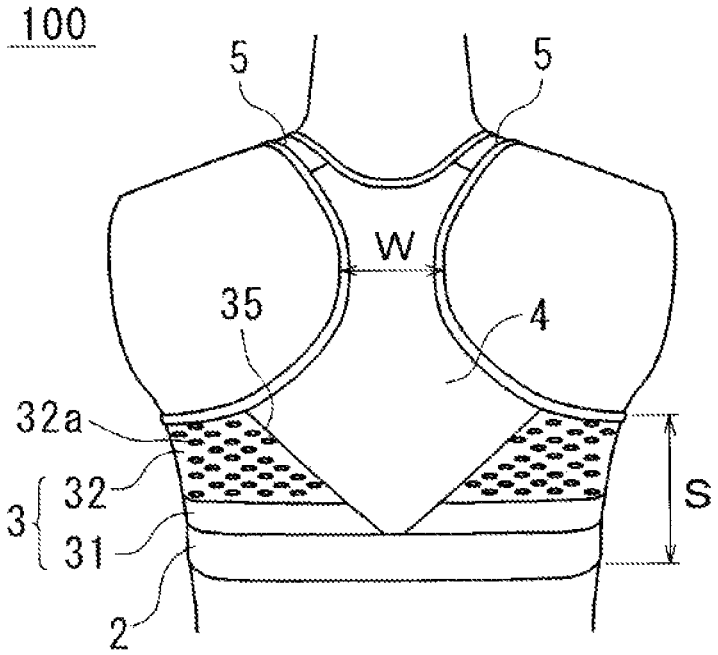
FIG. 2A is a rear view of the brassiere.
Figure 2B:
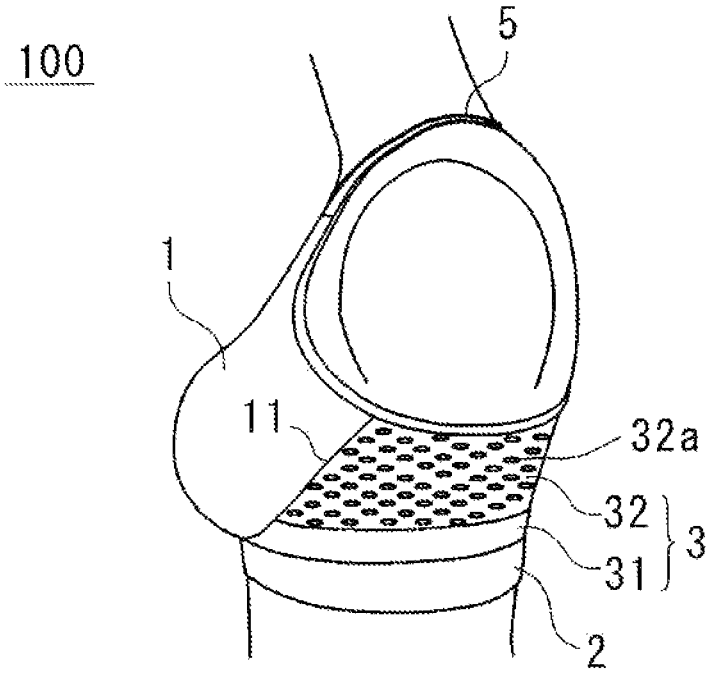
FIG. 2B is a side view of the brassiere.

FIG. 1 is a front view illustrating a brassiere 100 according to a first embodiment, FIG. 2A is a rear view of the brassiere 100, and FIG. 2B is a side view of the brassiere 100. The brassiere 100 includes a breast support portion 1, a belt portion 2, a body-side support portion 3, a back support portion 4, and a shoulder strap portion 5. The breast support portion 1 and the back support portion 4 are connected on the upper portions thereof by the shoulder strap portion 5 and are connected on the lower portions thereof to the belt portion 2, which goes around the chest from the front side of the chest to the back. For example, when a wearer moves her body to do training such as exercise and yoga, the brassiere 100 fits the wearer's chest to facilitate movement of her body and suppresses displacement at the wearer's chest.

The breast support portion 1, the belt portion 2, the back support portion 4, and the shoulder strap portion 5 are low in stretching properties in a lengthwise direction, which causes a holding property of the breasts in the lengthwise direction to be excellent. The belt portion 2 is preferably low in the stretching property in a circumferential direction and high in wearing compression at the underbust at the time of wearing to suppress displacement of the brassiere 100 at the chest. Since the breast support portion 1, the back support portion 4, and the shoulder strap portion 5, as well as the belt portion 2, are set to be low in the stretching properties in the lengthwise direction, the holding property of the breasts in the lengthwise direction is excellent.

The body-side support portion 3 is higher in the stretching property in the lengthwise direction than in the circumferential direction and reduces inhibition of stretch of the wearer's skin on the body side under the armpit when the wearer performs an arm raising movement. Also, since the body-side support portion 3 has a vertical double configuration, in which the stretching property of a lower support portion 31 in the lengthwise direction is lower than that of an upper support portion 32, connection on the body side between a lateral end 11 of the breast support portion 1 and the belt portion 2 is heightened, shape stability of the brassiere 100 is heightened, and the holding property of the breasts is secured.

Figure 3A:
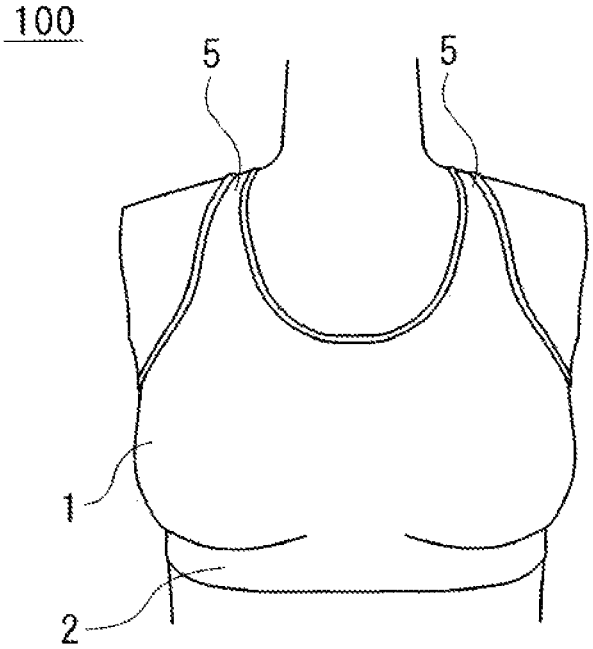
FIG. 3A is a front view of the brassiere of a seamless type.
Figure 3B:
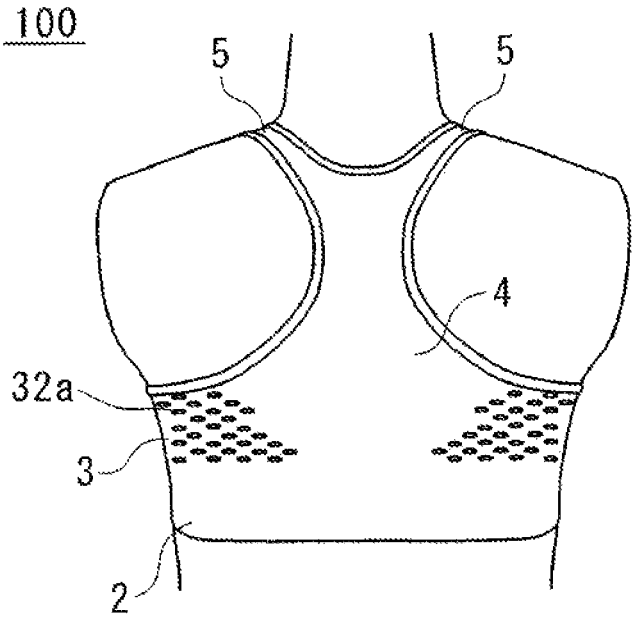
FIG. 3B is a rear view of the brassiere of the seamless type.

The brassiere 100 may be a seamless brassiere in which a fabric of the respective portions is integrally woven or a brassiere in which some or all of the respective portions are mutually sewn. FIG. 3A is a front view of the brassiere 100 of the seamless type, and FIG. 3B is a rear view of the brassiere 100 of the seamless type. As illustrated in FIGS. 3A and 3B, no seam or overlapping of fabrics can visually be recognized on the surface of the brassiere 100. In the brassiere 100, regions occupied by the respective portions such as the breast support portion 1, the belt portion 2, the body-side support portion 3, the back support portion 4, and the shoulder strap portion 5 differ in terms of stretching properties in the lengthwise direction and in the circumferential direction due to differences of the way to weave the fabric, the fiber direction, the amount of fiber used, and the like, application of resin or the like to the fiber, and the like.

Returning to FIG. 1, the breast support portion 1 is arranged to enfold the wearer's breasts of the chest from the lower to upper portions thereof and is in a stereoscopic shape in which the breast support portion 1 swells toward the front side of the chest. The shape and the size of the breast support portion 1 preferably correspond to the variety of sizes and shapes of breasts to reduce differences in the wearing compression in the range in which the breasts are located. The lower side of the breast support portion 1 is connected to the belt portion 2. The boundary (including the lateral end 11) between the breast support portion 1 and the peripheral region thereof is formed along the verge line and is formed around the verge line including the verge line of the breasts or inside or outside the verge line. Meanwhile, the verge line means a line of a root of breasts of standard body shape at each sizes of the brassiere.

The belt portion 2 is connected to the lower portion of the breast support portion 1 and is in an elongated strip shape going around the chest from the front side of the chest to the back. At the center on the front side of the chest, a front-side connecting portion 6 is formed in a triangular region surrounded by the belt portion 2 and the breast support portion 1, and the lower center of the breast support portion 1 and the center of the belt portion 2 are connected by the front-side connecting portion 6. The upper portion of the belt portion 2 is connected to the body-side support portion 3 on the body side and on the back side.

The body-side support portion 3 is connected at one end side thereof to the lateral end 11 of the breast support portion 1 and is arranged from the body side under the armpit through the back side. The lower portion of the body-side support portion 3 is connected to the belt portion 2. The other end side of the body-side support portion 3 is connected to the back support portion 4. The body-side support portion 3 extends from the body side to the center of the back and is connected to the back support portion 4 at an inclined line 35 going downward on the center side of the back. The boundary between the lower support portion 31 and the upper support portion 32 is included in a lower portion than a half of a side height S of the brassiere 100 on the body side.

The body-side support portion 3 has a vertical double configuration including the lower support portion 31 and the upper support portion 32, the lower portion of the lower support portion 31 is connected to the belt portion 2, and the upper portion of the lower support portion 31 is connected to the upper support portion 32. The upper support portion 32 is provided with a plurality of openings 32*a* which are wide in the circumferential direction.

The back support portion 4 is in a Y shape, is connected on the upper portion thereof to the shoulder strap portion 5, and is connected on the lower portion thereof to the belt portion 2 and the body-side support portion 3. A shortest width W of the back support portion 4 is 5.5 cm or less, for example. Although the back support portion 4 illustrated in FIG. 2A is in the Y shape, the back support portion 4 may be in a straight type, which has a pair of elongated strips whose upper portions are connected to the right and left shoulder strap portions 5 and whose lower portions are connected to the belt portion 2 and the body-side support portion 3, or in a crossed type, in which paired strips are crossed. Although the back support portion 4 is preferably connected at the lower portion thereof to the belt portion 2, the lower portion may extend close to the belt portion 2, and the body-side support portion 3 may be interposed between the back support portion 4 and the belt portion 2.

The shoulder strap portion 5 is in an elongated strip shape, is connected to the upper portion of the breast support portion 1 on the front side of the chest, and is connected to the upper portion of the back support portion 4 on the back side. The width of the shoulder strap portion 5 is about 1 cm to 5 cm, for example.

Next, the stretching property of each portion will be described.

Figure 4:
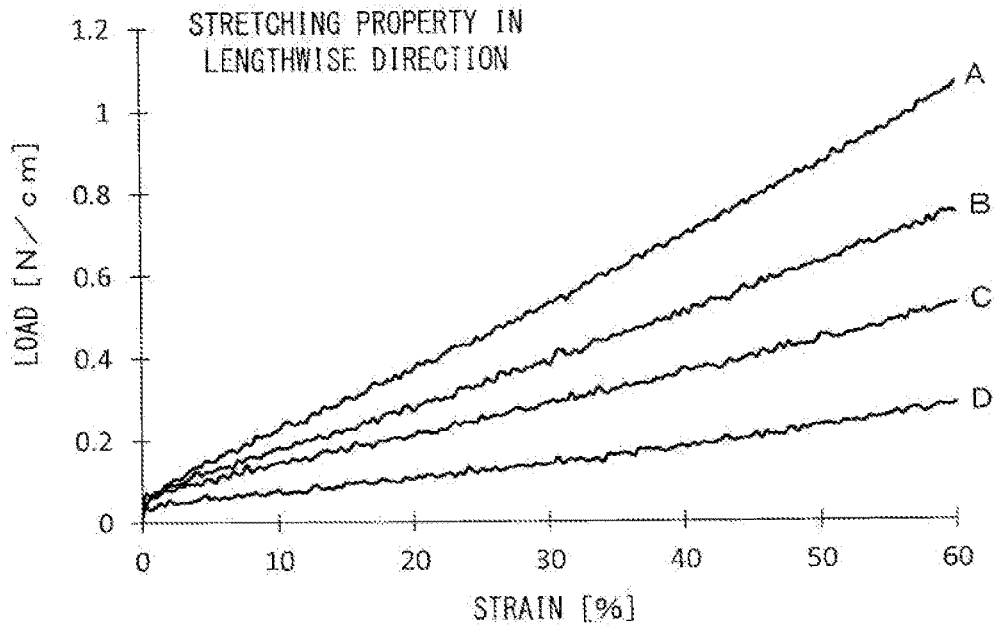
FIG. 4 is a graph illustrating stretching properties of knitted tissues used for respective portions in a lengthwise direction.
Figure 5:
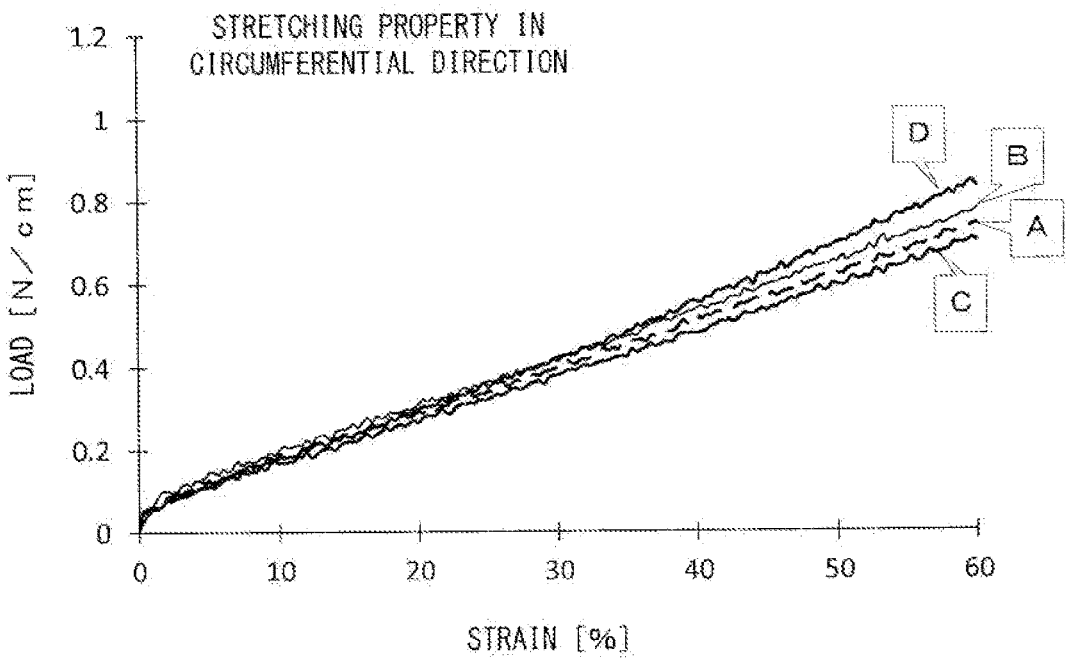
FIG. 5 is a graph illustrating the stretching properties of the knitted tissues used for the respective portions in a circumferential direction.

FIG. 4 is a graph illustrating the stretching properties of knitted tissues used for the respective portions in the lengthwise direction, and FIG. 5 is a graph illustrating the stretching properties of the knitted tissues used for the respective portions in the circumferential direction. Four knitted tissues are used and are referred to as knitted tissues A, B, C, and D, respectively. In the lengthwise direction, the stretching property of the knitted tissue A is lowest, and the stretching property is higher in order of the knitted tissues B, C, and D. In the circumferential direction, the stretching property of the knitted tissue D is lowest, and the stretching property is higher in order of the knitted tissues B, A, and C. The difference of the stretching property among the knitted tissues A, B, C, and D in the circumferential direction is smaller than that in the lengthwise direction. Meanwhile, by changing fiber used and a way of knitting based on a known technique, the stretching properties of the knitted tissues A, B, C, and D in the lengthwise direction and in the circumferential direction can be set. For example, the knitted tissues A, B, C, and D can differ in terms of the stretching properties in the lengthwise direction and in the circumferential direction due to differences of the way to weave the fabric, the fiber direction, the amount of fiber used, and the like, application of resin or the like to the fiber, and the like. Also, instead of the knitted tissue, a woven tissue, a non-woven fabric, or the like can be used for each portion. Note that the same is true for materials F, G, H, and I in a below-mentioned second embodiment.

FIG. 6 is a table illustrating the knitted tissues and the levels of the stretching properties corresponding to the respective portions. In FIG. 6, the stretching property is expressed in five levels from 1 to 5. The lowest level of the stretching property is 1 while the highest level thereof is 5. For the breast support portion 1, the knitted tissue B is used for the front fabric, and the knitted tissue C is used for the rear fabric. The stretching properties in the lengthwise direction and in the circumferential direction are 2, that is, the second lowest. For the belt portion 2, the two knitted tissues A overlap. The stretching properties in the lengthwise direction and in the circumferential direction are 1, that is, the lowest. Note that the knitted tissue B and the knitted tissue C in the breast support portion 1 overlap in equal directions so that the breast support portion 1 may have the stretching properties in the lengthwise direction and in the circumferential direction illustrated in FIGS. 4 and 5. Also, the two knitted tissues A in the belt portion 2 overlap in equal directions so that the belt portion 2 may have the stretching properties in the lengthwise direction and in the circumferential direction illustrated in FIGS. 4 and 5.

For the lower support portion 31 of the body-side support portion 3, the knitted tissue B is used. The stretching property in the lengthwise direction is 3, and that in the circumferential direction is 4. For the back support portion 4, the knitted tissue B is used, as well as for the lower support portion 31.

For the upper support portion 32 of the body-side support portion 3, the knitted tissue D is used. The stretching property in the lengthwise direction is 5, that is, the highest, and that in the circumferential direction is 3, that is, the third lowest. For the shoulder strap portion 5, the knitted tissue C is used. The stretching property in the lengthwise direction is 4, that is, the second highest, and that in the circumferential direction is 5, that is, the highest.

Next, effects of the brassiere 100 will be described.

Since the two overlapping knitted tissues A are used for the belt portion 2, the stretching property of the belt portion 2 in the circumferential direction is lower than any other part. Accordingly, the brassiere 100 is secured to the underbust of the wearer at the belt portion 2, and the belt portion 2 is prevented from displacing in the lengthwise direction in response to stretch of the body side of the wearer.

The body-side support portion 3 arranged on the body side of the wearer includes the upper support portion 32 having a high stretching property in the lengthwise direction and easily stretches and contracts along with stretch of the wearer's skin on the body side when the wearer performs an arm raising movement. Due to the body-side support portion 3, the brassiere 100 can reduce inhibition of stretch of the wearer's skin on the body side when the wearer performs an arm raising movement. Also, since the knitted tissue D having a high stretching property in the lengthwise direction is arranged exclusively for the upper support portion 32 of the body-side support portion 3, followability to stretch of the skin on the body side can be exerted without loosening of the entire brassiere 100 (lowering of the holding property in the lengthwise direction).

The stretching property of the upper support portion 32 in the circumferential direction is equivalent to those of the lower support portion 31, the back support portion 4, and the like. Also, the difference in the stretching property in the circumferential direction between the upper support portion 32 and the belt portion 2 is smaller than the difference in the stretching property in the lengthwise direction. Accordingly, the brassiere 100 is excellent in the holding property of the breasts in the circumferential direction.

The lower support portion 31 of the body-side support portion 3 is lower in the stretching property in the lengthwise direction than the upper support portion 32, heightens connection on the body side between the lateral end 11 of the breast support portion 1 and the belt portion 2, heightens shape stability of the brassiere 100, and secures the holding property of the breasts. Although the body-side support portion 3 has the vertical double configuration including the lower support portion 31 and the upper support portion 32, the body-side support portion 3 may have a configuration in which the lower support portion 31 is dispensed with, and in which the upper support portion 32 is connected to the belt portion 2. Meanwhile, the lower portion of the body-side support portion 3 may not partially or entirely be connected to the belt portion 2.

Since the upper support portion 32 of the body-side support portion 3 is provided with the plurality of openings 32*a* which are wide in the circumferential direction, the stretching property in the lengthwise direction is higher than that in the circumferential direction. Meanwhile, the upper support portion 32 can have the equivalent stretching property in the lengthwise direction without having the plurality of openings 32*a*.

Since the breast support portion 1 has the knitted tissues B and C overlapping, the breast support portion 1 can have a stretching property which is lower than or equivalent to that of the belt portion 2 to heighten the holding property of the breasts, can prevent the breasts from being seen through, and can provide pockets for inserting cups. In a case in which the breast support portion 1 has the two knitted tissues B overlapping, the wearing compression to the breasts increases, which makes the wearer feel that the brassiere 100 is hard. For this reason, the knitted tissue C having a higher stretching property than the knitted tissue B is used for the rear fabric. Note that, for the front-side connecting portion 6 arranged on the lower side of the breast support portion 1, a knitted tissue except the knitted tissue D having a high stretching property in the lengthwise direction is arranged.

The stretching property of the shoulder strap portion 5 is lower due to the influence of a hemmed part in addition to the stretching property of the knitted tissue C. The stretching property of the shoulder strap portion 5 including the hemmed part is preferably equivalent to or higher than the stretching property of the back support portion 4, for example, to secure the holding property of the breasts in the lengthwise direction. Note that the shoulder strap portion 5 may be equivalent to the knitted tissue of the breast support portion 1 or the back support portion 4 and may be formed integrally with the breast support portion 1 and the back support portion 4 by extending the breast support portion 1 and the back support portion 4. Also, the shoulder strap portion 5 and the front-side connecting portion 6 may have a design property on the surface that appears externally.

Modification Example

Figure 7A:
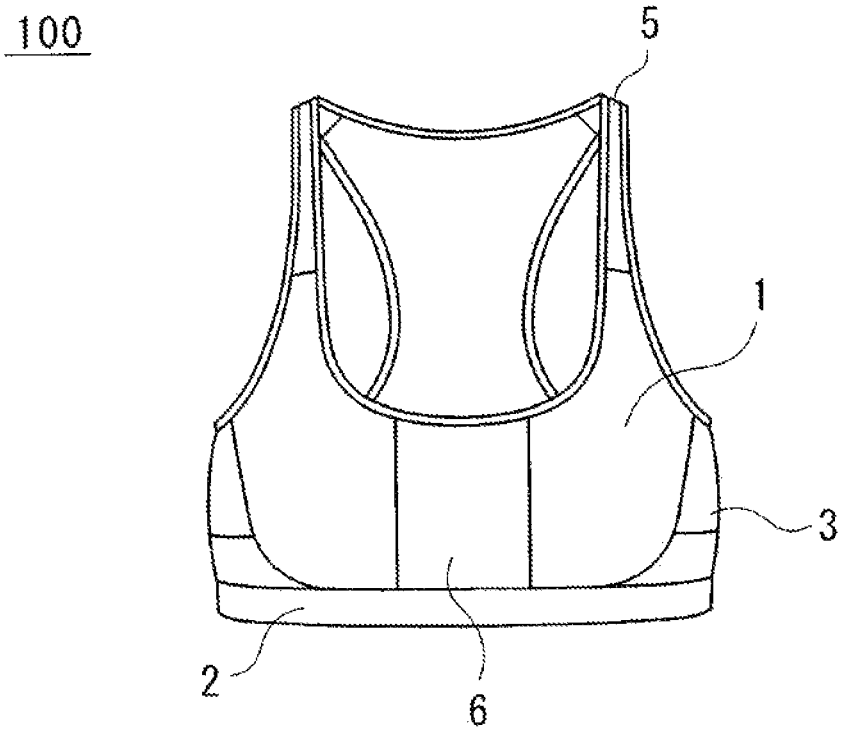
FIG. 7A is a front view of the brassiere according to a modification example.
Figure 7B:
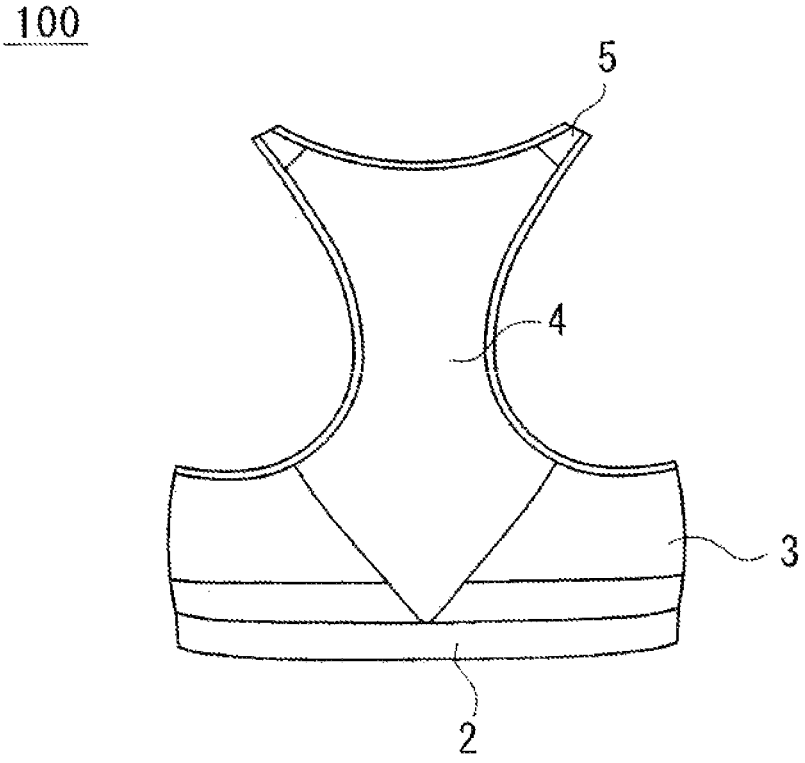
FIG. 7B is a rear view of the brassiere.

FIG. 7A is a front view of the brassiere 100 according to a modification example, and FIG. 7B is a rear view of the brassiere 100. The brassiere 100 according to the modification example has a configuration in which the region of the front-side connecting portion 6 is enlarged. The upper end of the front-side connecting portion 6 corresponds to the neckline of the brassiere 100, and the lower end thereof is connected to the belt portion 2. The right and the left of the front-side connecting portion 6 are formed further on the center side of the chest than the top positions of the right and left breasts. In this case, the breast support portion 1 is formed in a pair of regions separated to the right and the left.

Figure 8A:
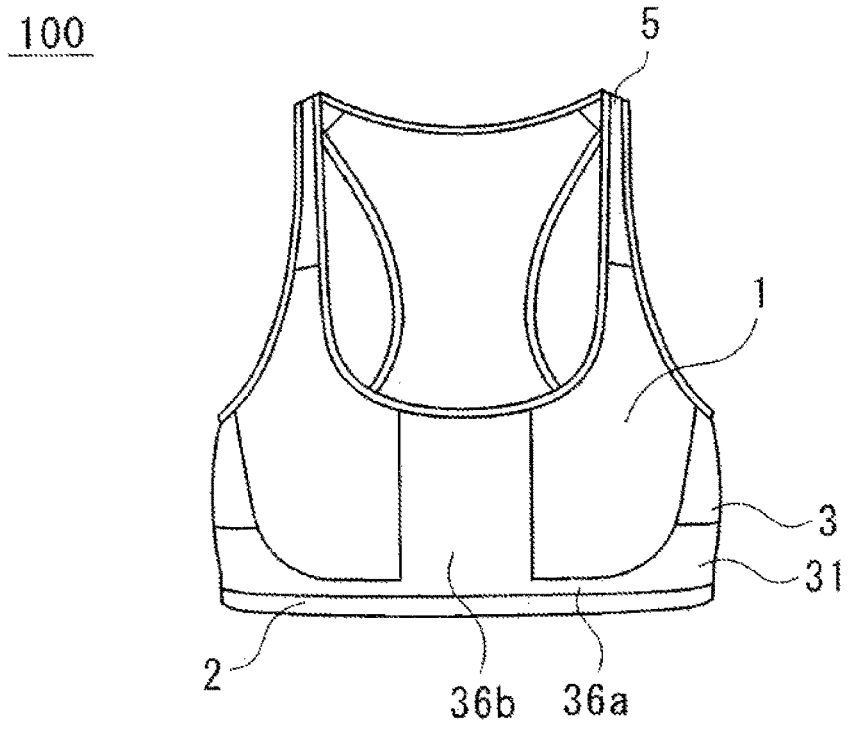
FIG. 8A is a front view of the brassiere according to another modification example.
Figure 8B:
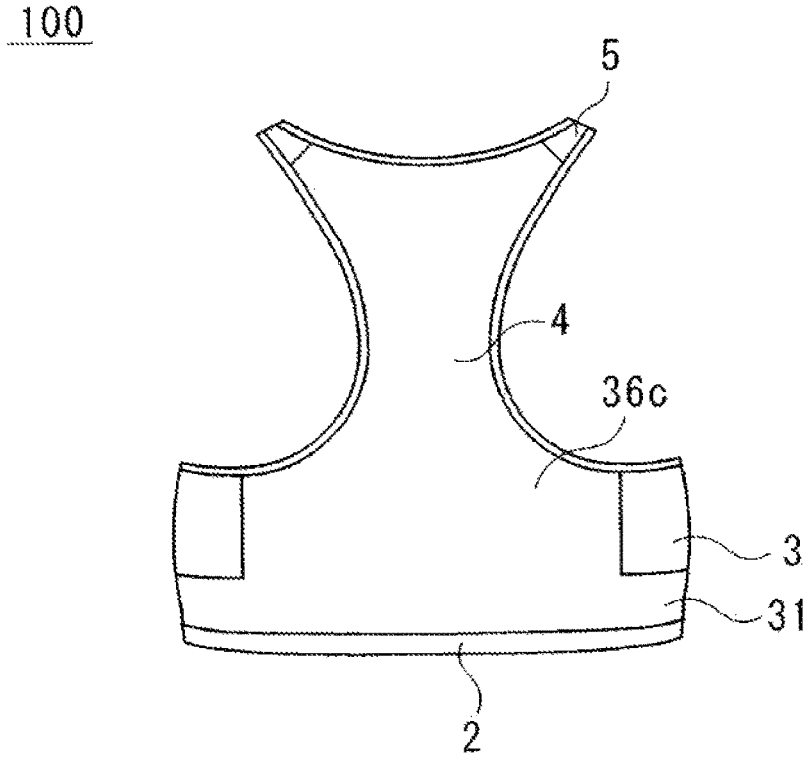
FIG. 8B is a rear view of the brassiere.

FIG. 8A is a front view of the brassiere 100 according to another modification example, and FIG. 8B is a rear view of the brassiere 100. The brassiere 100 according to the other modification example has a configuration in which the lower support portion 31 of the body-side support portion 3 is enlarged. The lower support portion 31 of the body-side support portion 3 is enlarged to include a part 36*a* interposed between the breast support portion 1 and the belt portion 2 on the front side of the chest, a part 36*b* comparable to the enlarged front-side connecting portion 6 illustrated in FIG. 7A, and a part 36*c* of the upper support portion 32 on the back side. In this case, the upper support portion 32 is formed at least as a region on the body side.

In a case in which the back support portion 4 and the lower support portion 31 are made of an equal knitted tissue, the lower support portion 31 can be an enlarged region including the part 36*a*, the part 36*b*, the part 36*c*, and the back support portion 4. Meanwhile, all of the part 36*a*, the part 36*b*, and the part 36*c* may be provided, or one or a plurality of the part 36*a*, the part 36*b*, and the part 36*c* may be selected and partially provided.

In each of the aforementioned embodiment and modification examples, the combination of the knitted tissues A, B, C, and D is cited as a combination example having a variety of stretching properties, and a combination of knitted tissues used for the brassiere 100 is not limited to the combination of the knitted tissues A, B, C, and D. Also, the number of the knitted tissues used for the brassiere 100 is not limited to four but may be four or more or less than four.

Second Embodiment

Figure 9:
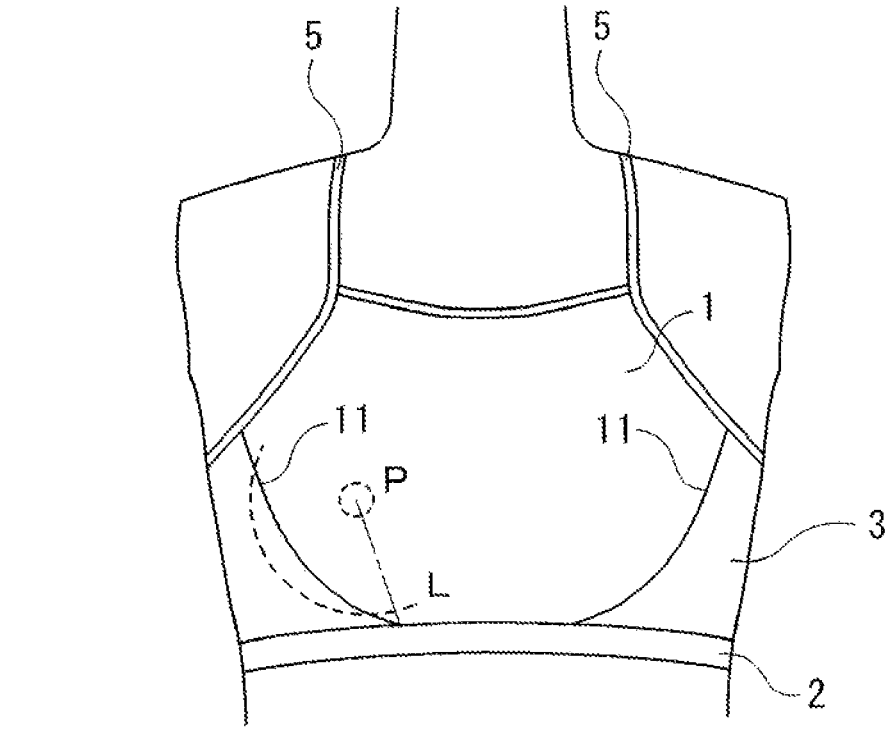
FIG. 9 is a front view illustrating the brassiere according to a second embodiment.
Figure 10A:
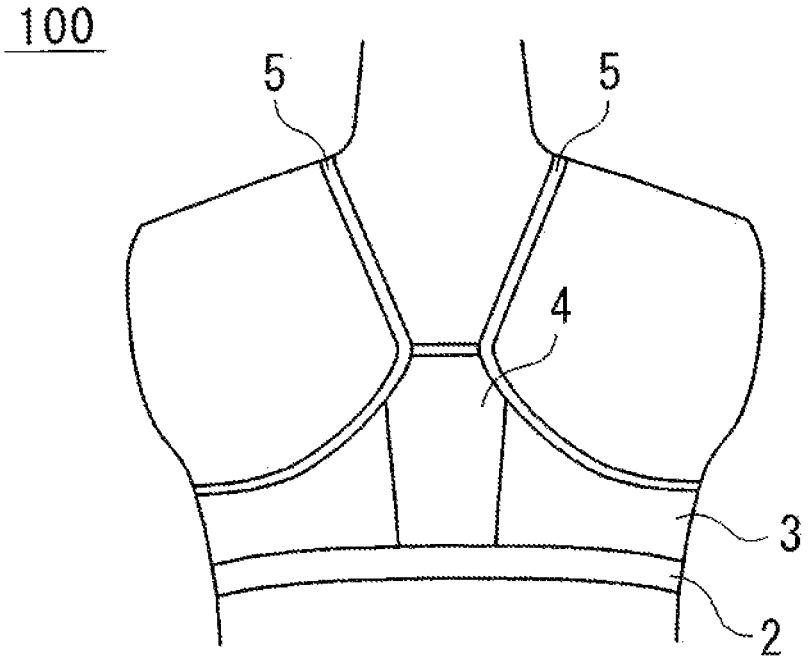
FIG. 10A is a rear view of the brassiere.
Figure 10B:
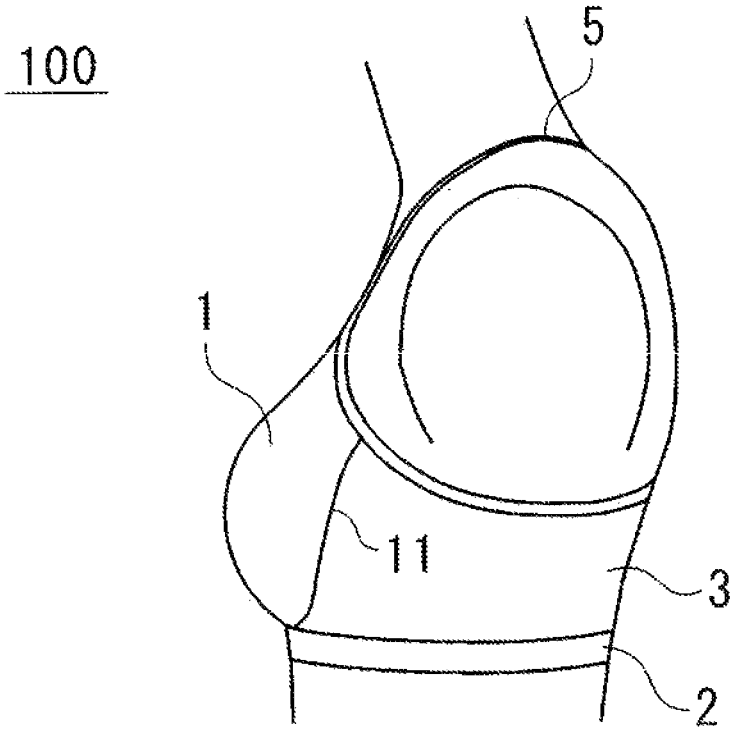
FIG. 10B is a side view of the brassiere.
Figure 11:
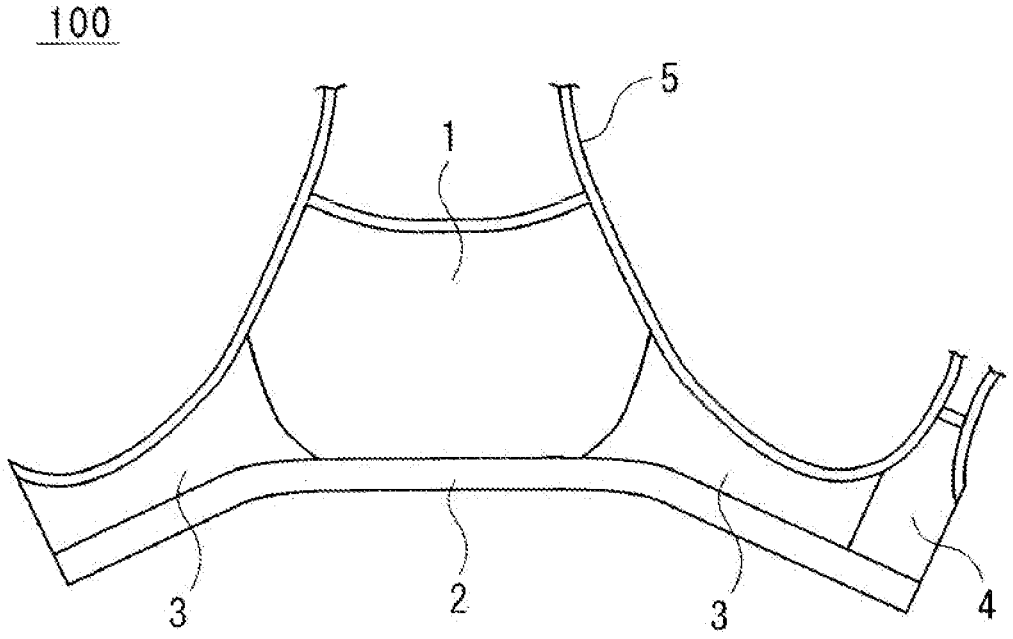
FIG. 11 is a developed view of the brassiere.

FIG. 9 is a front view illustrating the brassiere 100 according to a second embodiment, FIG. 10A is a rear view of the brassiere 100, and FIG. 10B is a side view of the brassiere 100. FIG. 11 is a developed view of the brassiere 100. The brassiere 100 according to the second embodiment includes the breast support portion 1, the belt portion 2, the body-side support portion 3, the back support portion 4, and the shoulder strap portion 5 in a similar manner to the brassiere 100 according to the first embodiment.

In the brassiere 100 according to the second embodiment, the body-side support portion 3 having a high stretching property in the lengthwise direction is provided to extend inside a verge line L (the dashed line illustrated in FIG. 9) of the breasts and is arranged toward the lower side of the center of the chest in the verge line L. Also, the breast support portion 1 has a low stretching property in the lengthwise direction and has a higher stretching property in the circumferential direction than that in the lengthwise direction.

When the wearer performs an arm raising movement, the skin in the chest on the body side significantly stretches in the lengthwise direction, and stretch in the lengthwise direction of the skin around the verge line, particularly the skin in the region from the lower portion of the breasts inside the verge line to the lower side (including the lower direction, the same applies hereinbelow) of the verge line, is also significantly generated in association with the stretch on the body side. In the brassiere 100, since the body-side support portion 3 is enlarged to reach the periphery of the verge line and the lower side of the verge line, inhibition of stretch of the skin on the periphery of the verge line and on the lower side of the verge line in the lengthwise direction is reduced, and in addition, inhibition of stretch of the skin on the body side in the lengthwise direction is further reduced. Also, due to the breast support portion 1, the brassiere 100 is excellent in the holding property of the breasts in the lengthwise direction and stretches in the circumferential direction to fit swell of the breasts.

For example, when a wearer moves her body to do training such as exercise and yoga, the brassiere 100 fits the wearer's chest to facilitate movement of her body and suppresses displacement at the wearer's chest. In particular, since the brassiere 100 reduces inhibition of stretch in the lengthwise direction of the skin around the verge line, particularly the skin in the region from the lower portion of the breasts inside the verge line to the verge line lower side, the brassiere 100 has a configuration that is suitable for wear for sports such as swimming requiring a vigorous arm raising movement.

The breast support portion 1 is arranged from the center on the front side of the wearer's chest to the outside and is formed in a range including top positions P of the breasts in the circumferential direction. The lower portion of the breast support portion 1 is connected to the belt portion 2. The lateral end 11 of the breast support portion 1 is connected to the body-side support portion 3. The lateral end 11 is in a curved or linear shape inclined downward toward the center of the chest. In consideration of the configuration in which the breast support portion 1 is formed to include the top positions P of the breasts, the lateral end 11 of the breast support portion 1 is preferably in a curved shape going outward.

Figure 12A:
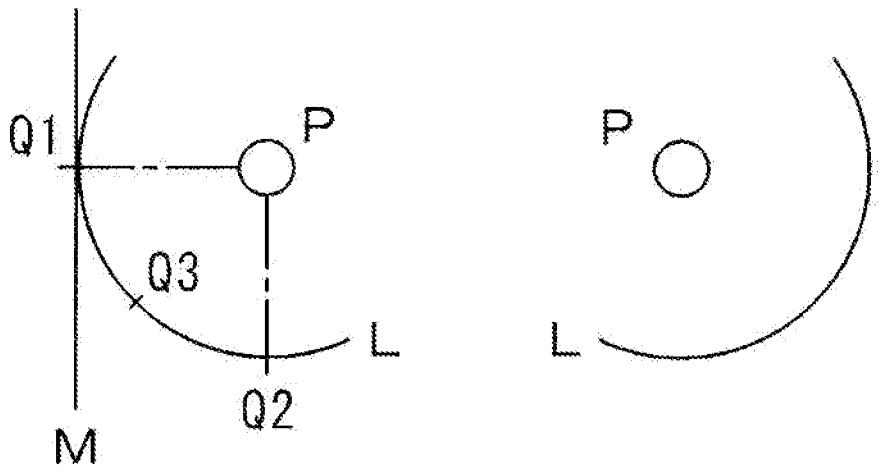

The upper end of the lateral end 11 of the breast support portion 1 is located at the outside of the shoulder strap portion 5, and the lower end thereof is located at the connecting portion to the belt portion 2 located further on the inner side than the upper end. The lateral end 11 is formed in a curved shape in which the lateral end 11 passes from the upper end thereof inside the verge line L, goes down toward the center of the chest, crosses the verge line L on the lower side of the verge line L, and reaches the lower end thereof. The lower end portion of the lateral end 11 crossing the upper side of the belt portion 2 is provided on the lower side of the top position P of the breast or at a position located further on the center side of the chest than the top position P, for example. FIGS. 12A, 12B, 12C and 12D are schematic views describing the verge line L and the like. In FIG. 12A, an intersection point between a horizontal line at the top position P of the breast and the verge line L is referred to as Q1, an intersection point between a vertical line at the top position P of the breast and the verge line L is referred to as Q2, and a midpoint on the verge line L equidistant from Q1 and Q2 is referred to as Q3. In the verge line L, a part further on the inner side (the center side of the chest) than Q3 is defined as a verge line lower side, and a part further on the outer side than Q3 is defined as a verge line outer side. Also, in FIGS. 12A to 12D, a line segment M is a line segment indicating an outermost side of the verge line outer side. An outside (a side illustrated by the arrow) of the line segment M is a region that stretches in the lengthwise direction particularly well on the body side of the wearer. The upper end of the lateral end 11 of the breast support portion 1 may be located outside the line segment M. However, in this case, the lateral end 11 is preferably formed to cross the line segment M.

Figure 12B:
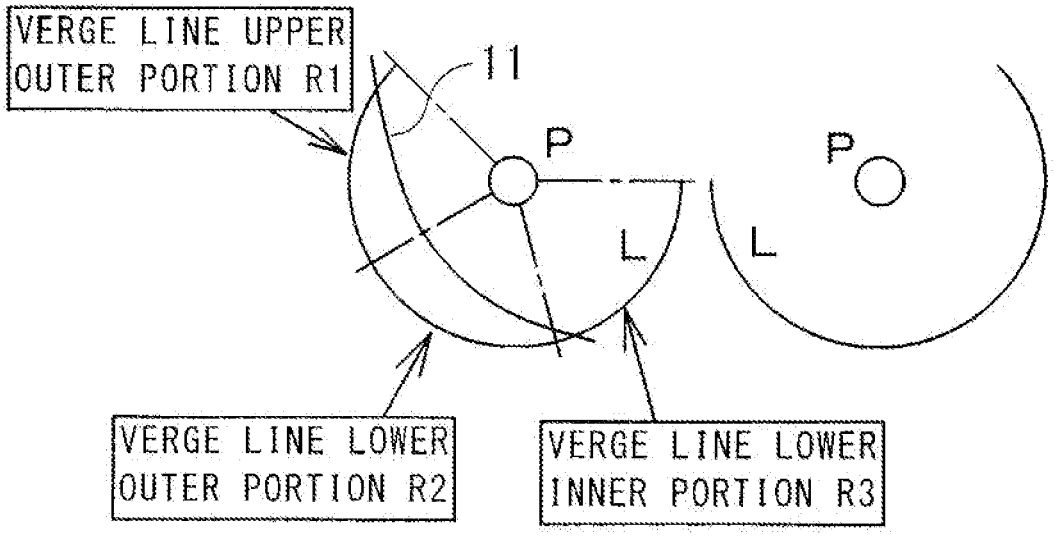

Also, consider the verge line L by dividing the verge line L into plural parts as illustrated in FIG. 12B. For example, in a case in which parts of the verge line are compared to a clock, a verge line upper outer portion R1 is a part in a range from 8 o'clock to 10:30, a verge line lower outer portion R2 is a part in a range from 5:30 to 8 o'clock, and a verge line lower inner portion R3 is a part in a range from 3 o'clock to 5:30. Since at least a part of the lateral end 11 of the breast support portion 1 is formed inside the verge line lower outer portion R2, the body-side support portion 3 can be enlarged to cover the skin around the verge line, particularly a region from the lower portion of the breast inside the verge line to the verge line lower side, and the region of the body-side support portion 3 around the verge line and at the verge line lower side can be enlarged. Also, since at least a part of the lateral end 11 of the breast support portion 1 is formed inside the verge line upper outer portion R1, the region of the body-side support portion 3 at the outside of the breast can be enlarged. Also, since at least a part of the lateral end 11 of the breast support portion 1 is formed inside the verge line lower inner portion R3, the region of the body-side support portion 3 at the lower side of the breast can further be enlarged. Also, the area of the body-side support portion 3 covering the inside of the verge line is larger at the verge line upper outer portion R1 than at the verge line lower inner portion R3 and is larger at the verge line lower outer portion R2 than at the verge line upper outer portion R1. Consequently, in the brassiere 100, the lateral end 11 of the breast support portion 1 is formed as an inclined line going downward toward the center of the chest.

Figure 12C:
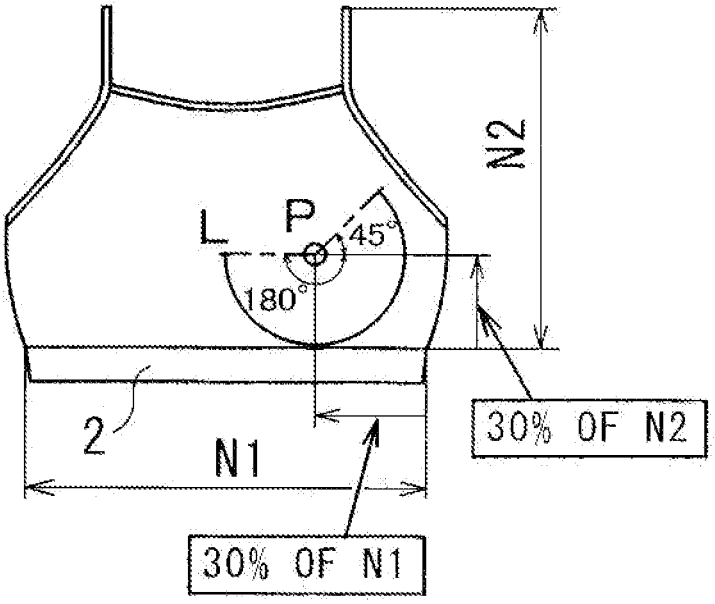

A position of the verge line L in an actual brassiere can be found based on a relationship with an external shape of the brassiere. As illustrated in FIG. 12C, the top position P of the breast can be found as a point satisfying the following three conditions.

(1) The point is located on the front side of the brassiere.

(2) The point is located at a position further on the inner side than the right or left end of the upper side of the belt portion 2 in a flattened state by approximately 30% of a distance N1 between the right and left ends of the upper side of the belt portion 2 in the flattened state.

(3) The point is located at a position further on the upper side in the lengthwise direction than the upper side of the belt portion 2 by approximately 30% of a length N2 from the upper end of the shoulder strap portion 5 to the upper side of the belt portion 2.

Also, the verge line L can be found as an arc, in a range from 1:30 to 9 o'clock, of a circle centering on the top position P of the breast and having a diameter which is approximately 47% of N1.

Figure 12D:
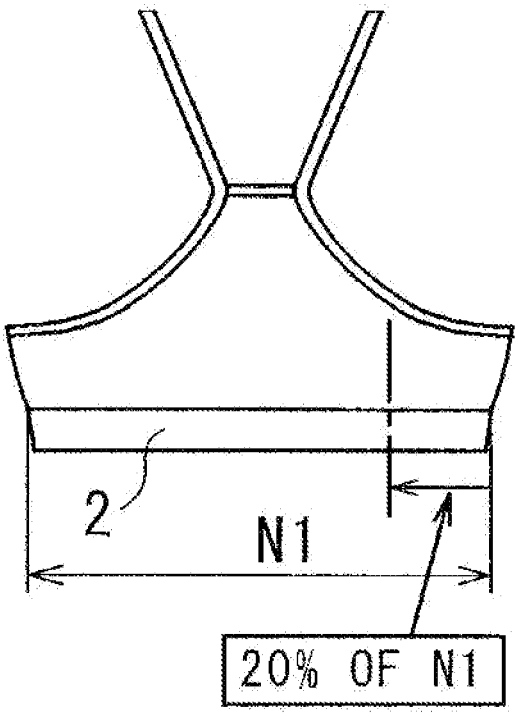

Also, as for a range of the body-side support portion 3, the body-side support portion 3 is connected to the breast support portion 1 on the front surface of the body and is at least in a 20% range of the distance N1 from the right or left end of the belt portion 2 in the flattened state on the back surface of the body as illustrated in FIG. 12D, for example. Also, the body-side support portion 3 may be at least in a 10% range of the distance N1 from the right or left end of the belt portion 2 in the flattened state on the back surface of the body. In this case as well, the body-side support portion 3 can cover the body side of the body. Note that the top position P, the verge line L, and the range of the body-side support portion 3 in the brassiere can be found in a similar manner in the first embodiment.

The belt portion 2 is connected to the lower portion of the breast support portion 1 and is in an elongated strip shape going around the chest from the front side of the chest to the back. The body-side support portion 3 is connected at one end side thereof to the lateral end 11 of the breast support portion 1 and is arranged from the body side under the armpit through the back side. The lower portion of the body-side support portion 3 is connected to the belt portion 2. The other end side of the body-side support portion 3 is connected to the back support portion 4. The back support portion 4 is in a rectangular shape, is connected on the upper portion thereof to the shoulder strap portion 5, and is connected on the lower portion thereof to the belt portion 2. The shoulder strap portion 5 is in a string shape, is connected to the upper portion of the breast support portion 1 on the front side of the chest, and is connected to the upper portion of the back support portion 4 on the back side.

Next, stretching properties of the respective portions and effects of the brassiere 100 will be described.

Figure 13:
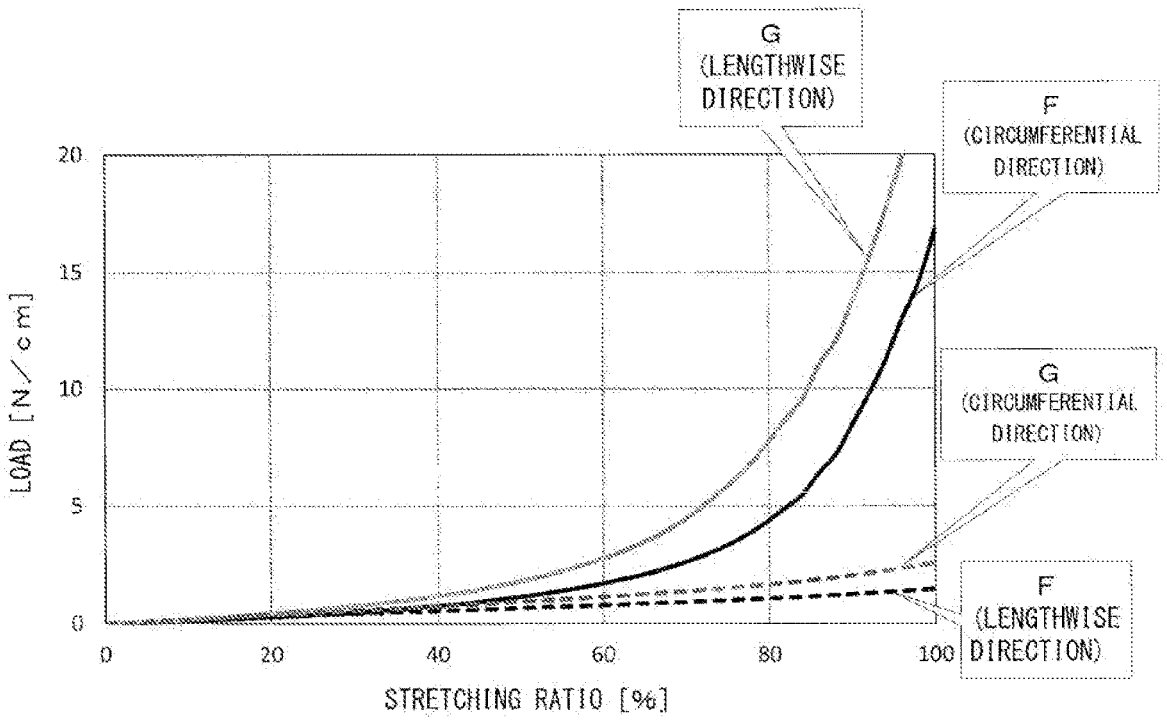
FIG. 13 is a graph illustrating stretching properties of a material F and a material G in the lengthwise direction and in the circumferential direction.

As materials that form the respective portions, materials F, G, H, and I are used. The material F is used for the body-side support portion 3, and the material G is used for the breast support portion 1. Also, the material H is used for the back support portion 4, and the material I is used for the belt portion 2. FIG. 13 is a graph illustrating stretching properties of the material F and the material G in the lengthwise direction and in the circumferential direction. The material F is single and made of a main fabric, for example, and the material G is double and made of a main fabric and a rear fabric attached to the main fabric, for example. The stretching property in the lengthwise direction of the material F for the body-side support portion 3 is higher than that of the material G for the breast support portion 1. Conversely, the stretching property in the circumferential direction of the material G for the breast support portion 1 is higher than that of the material F for the body-side support portion 3. Also, as for the material F for the body-side support portion 3, the stretching property thereof in the circumferential direction is lower than that in the lengthwise direction. Also, as for the material G for the breast support portion 1, the stretching property thereof in the lengthwise direction is lower than that in the circumferential direction.

Since the stretching property of the body-side support portion 3 in the lengthwise direction is higher than that of the breast support portion 1, the body-side support portion 3 of the brassiere 100 stretches to follow the skin from the body side to the periphery of the verge line and the verge line lower side to reduce inhibition of stretch of the skin from the body side to the periphery of the verge line and the verge line lower side.

Since the stretching property of the body-side support portion 3 in the circumferential direction is lower than that in the lengthwise direction, the brassiere 100 easily fits the body trunk of the wearer.

Since the stretching property of the breast support portion 1 in the lengthwise direction is lower than that in the circumferential direction, the holding property causing the brassiere 100 to hold the chest in the lengthwise direction is excellent, and in the circumferential direction, the breast support portion 1 fits swell of the breasts and suppresses excessive constriction of the chest. Also, since the stretching property of the body-side support portion 3 in the circumferential direction is lower than the stretching property of the breast support portion 1 in the circumferential direction, the body-side support portion 3, enlarged to reach the lower portion of the breast, lifts the breast from the bottom, and the shape holding property of the breasts can be improved.

The stretching properties in the lengthwise direction of the material H used for the back support portion 4 and the material I used for the shoulder strap portion 5 are lower than that of the material F used for the body-side support portion 3. In the brassiere 100, since the stretching properties in the lengthwise direction of the breast support portion 1, the belt portion 2, the back support portion 4, and the shoulder strap portion 5 are lower than that of the body-side support portion 3, the holding property of the breasts in the lengthwise direction can be improved.

The stretching property in the circumferential direction of the material I used for the belt portion 2 is assumed to be lower than those of the material F used for the body-side support portion 3 and the material G used for the breast support portion 1. Since the stretching property in the circumferential direction of the material I used for the belt portion 2 is lower, the brassiere 100 is firmly secured to the underbust of the wearer at the belt portion 2.

Modification Example

Figure 14A:
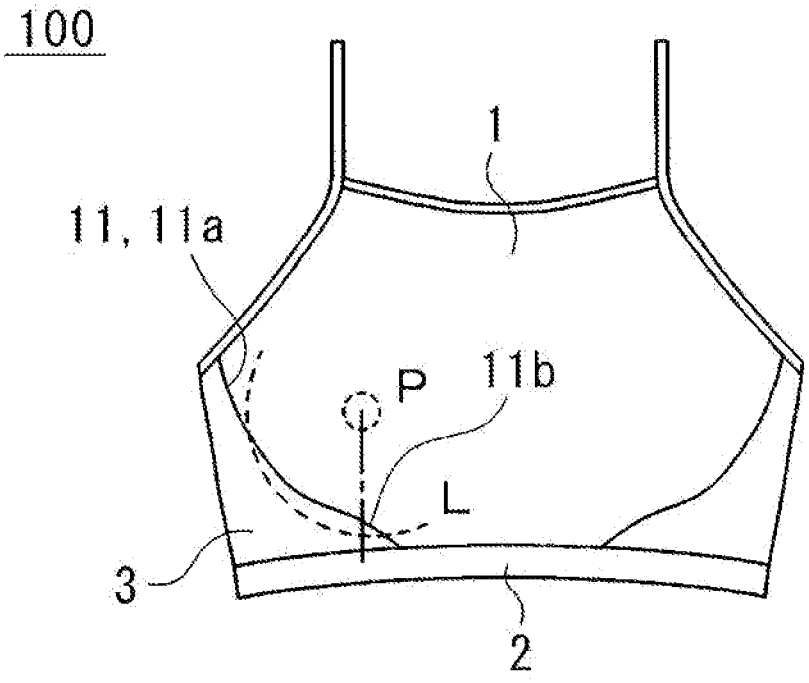
FIGS. 14A and 14B are front views of the brassiere according to modification examples.
Figure 14B:
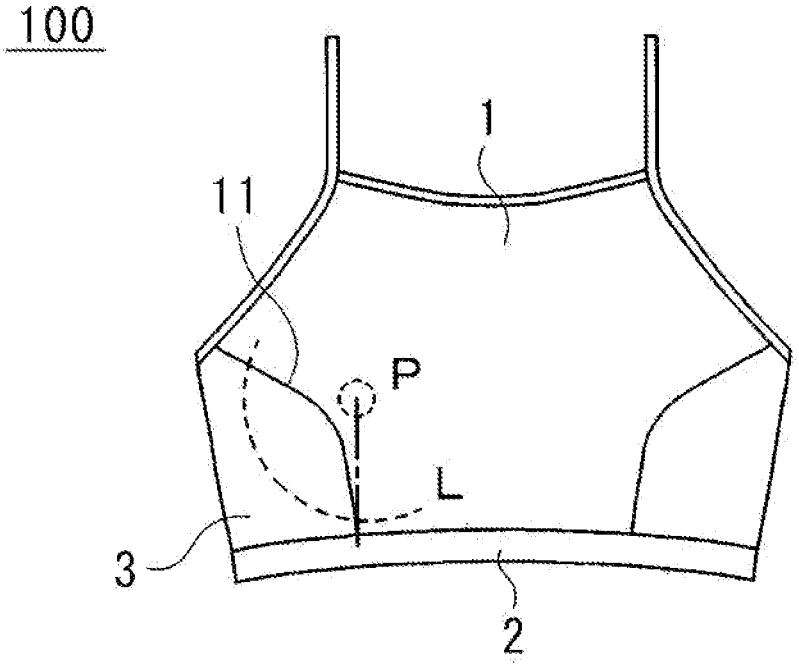

FIGS. 14A and 14B are front views of the brassiere 100 according to modification examples. The brassiere 100 illustrated in FIG. 14A includes a part 11*a* of the lateral end 11 of the breast support portion 1 going outward on the upper side of the lateral end 11 and a part 11*b* going inward on the lower side of the lateral end 11. The body-side support portion 3 extends to the region on the front side of the chest along the part 11*b* of the lateral end 11 and stretches to follow stretch of the skin on the periphery of the verge line and at the verge line lower side. Also, in the brassiere 100 illustrated in FIG. 14B, the lateral end 11 of the breast support portion 1 is in a curved shape entirely going inward. Since the region of the body-side support portion 3 is enlarged, followability to stretch of the skin from the body side of the wearer to the periphery of the verge line and the verge line lower side increases.

Figure 15A:
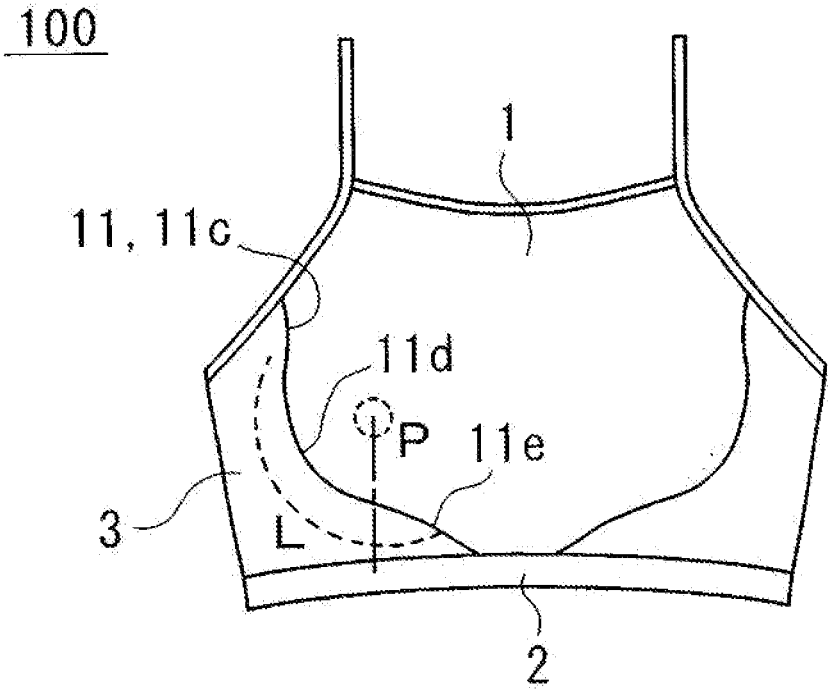
FIGS. 15A and 15B are front views of the brassiere according to other modification examples.
Figure 15B:
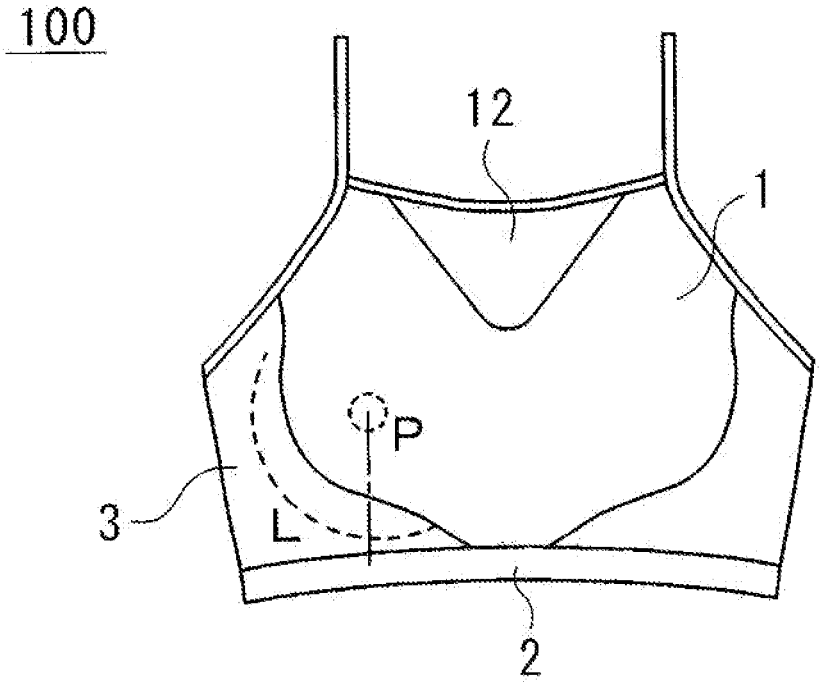

FIGS. 15A and 15B are front views of the brassiere 100 according to other modification examples. The brassiere 100 illustrated in FIG. 15A includes a part 11*c* of the lateral end 11 of the breast support portion 1 going inward on the upper side of the lateral end 11, a part 11*d* going outward at the middle portion of the lateral end 11, and a part 11*e* going inward on the lower side of the lateral end 11. The breast support portion 1 is formed as a region in which the lateral end 11 includes the top positions P of the breasts. Since the region of the body-side support portion 3 is enlarged on the upper side and the lower side due to the part 11*c* and the part 11*e*, followability to stretch of the skin from the body side of the wearer to the periphery of the verge line and the verge line lower side increases.

In the brassiere 100 illustrated in FIG. 15B, the line of the lateral end 11 of the breast support portion 1 is equivalent to that in FIG. 15A, and at the upper center portion of the breast support portion 1, a different material from that for the breast support portion 1 is arranged at a region 12 circled by an inclined line going downward as the line approaches the center. For example, an equivalent material to the body-side support portion 3 may be arranged in the region 12 to heighten the stretching property in the lengthwise direction.

Figure 16A:
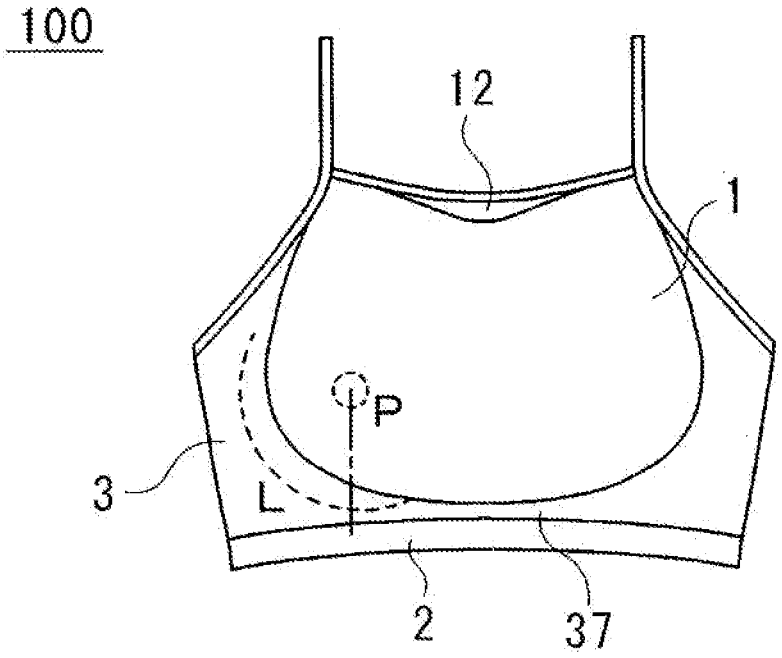
FIGS. 16A and 16B are front views of the brassiere according to still other modification examples.
Figure 16B:
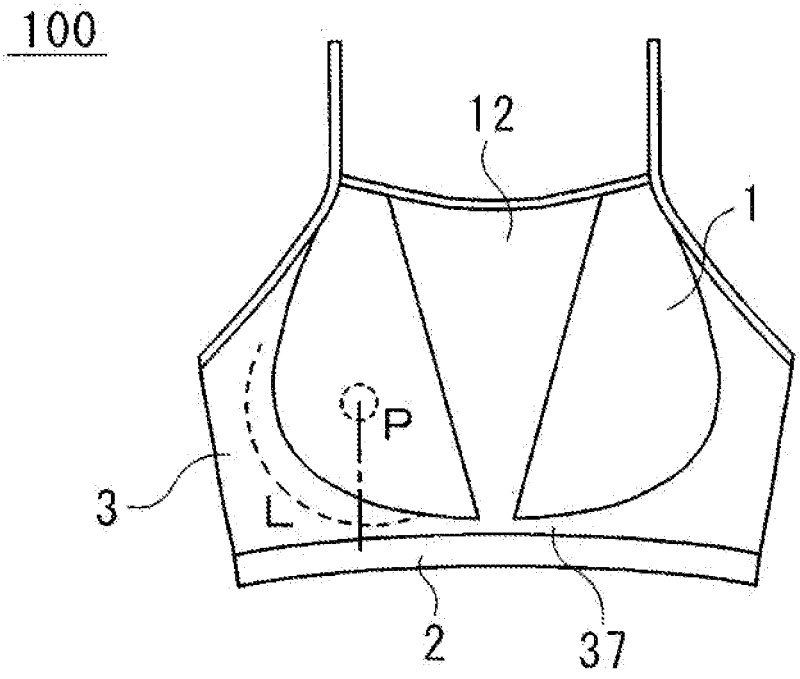

FIGS. 16A and 16B are front views of the brassiere 100 according to still other modification examples. The brassiere 100 illustrated in FIG. 16A has a configuration in which a part 37 extending from the body-side support portion 3 is interposed between the lower portion of the breast support portion 1 and the belt portion 2. Also, at the upper center portion of the breast support portion 1, a different material from that for the breast support portion 1 is arranged at the region 12 circled by an inclined line going downward as the line approaches the center. Since the part 37 extends from the body side to the center on the front side of the chest, the brassiere 100 can stretch to follow stretch of the skin in a broader range on the periphery of the verge line and at the verge line lower side.

The brassiere 100 illustrated in FIG. 16B has an equivalent configuration to that in FIG. 16A, in which the part 37 extending from the body-side support portion 3 is interposed between the lower portion of the breast support portion 1 and the belt portion 2, and the region 12 is provided to reach the part 37. For example, an equivalent material to the body-side support portion 3 may be arranged in the region 12 to heighten the stretching property in the lengthwise direction at the center on the front side of the chest.

In each of the first embodiment, the second embodiment, and the respective modification examples described above, the brassiere 100 formed on the chest of the wearer has been described. However, the present invention can be applied to wear such as a T shirt and an inner shirt provided with the structure of the brassiere 100, one-piece swimwear formed by adding a part provided from the belt portion 2 to the lower body on the front side and the rear side of the body and combining the part with a pants part, and the like.

Third Embodiment

Figure 17A:
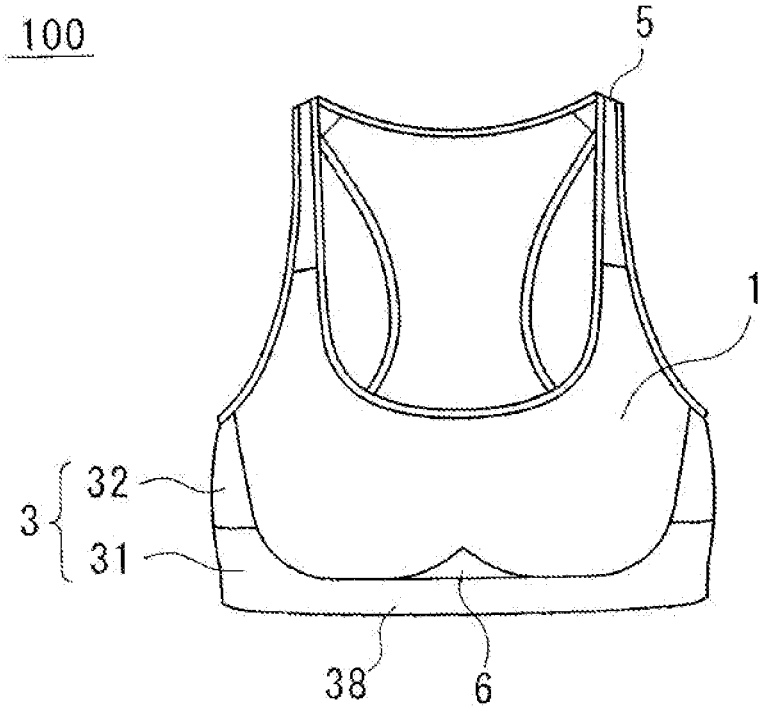
FIG. 17A is a front view illustrating the brassiere according to a third embodiment.
Figure 17B:
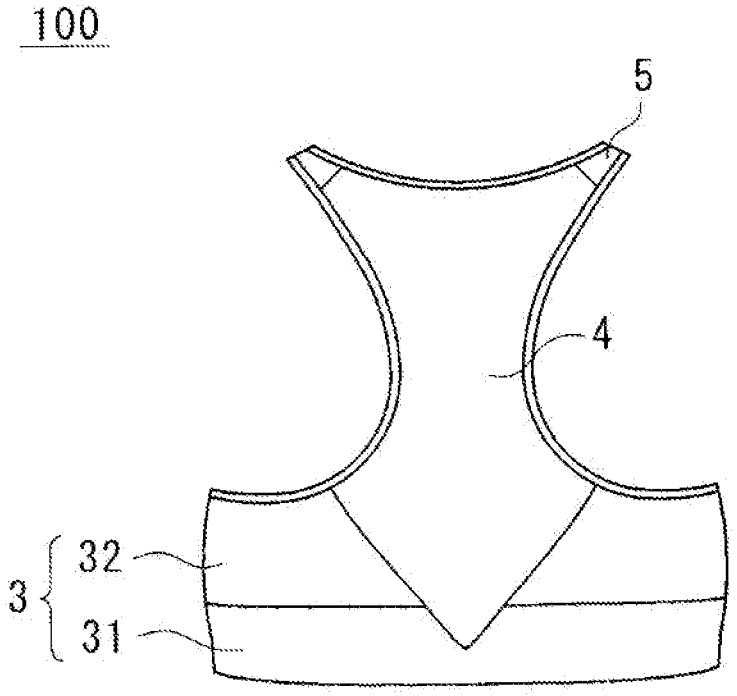
FIG. 17B is a rear view of the brassiere.

FIG. 17A is a front view illustrating a brassiere 100 according to a third embodiment, and FIG. 17B is a rear view of the brassiere 100. The brassiere 100 according to the third embodiment includes a breast support portion 1, a body-side support portion 3, a back support portion 4 and a shoulder strap portion 5, and has a configuration in which a belt portion 2 is dispensed with. The lower support portion 31 of the body-side support portion 3 includes a part 38 extending to the center on the front side of the chest, and has shape going around the chest. The part 38 on the front side of the chest of the lower support portion 31 has a configuration of using the equivalent knitted tissues of the lower support portion 31 and is connected to the lower portion of the breast support portion 1.

Since the lower support portion 31 has shape going around the chest, the brassiere 100 fits the wearer's chest and suppresses displacement at the wearer's chest. As mentioned above, the upper support portion 32 of the body-side support portion 3 has a high stretching property in the lengthwise direction and can reduce inhibition of stretch of the wearer's skin on the body side when the wearer performs an arm raising movement. The stretching property of the upper support portion 32 in the circumferential direction is equivalent to those of the lower support portion 31, the back support portion 4, and the like, and the upper support portion 32 is excellent in the holding property of the breasts in the circumferential direction.

Figure 18B:
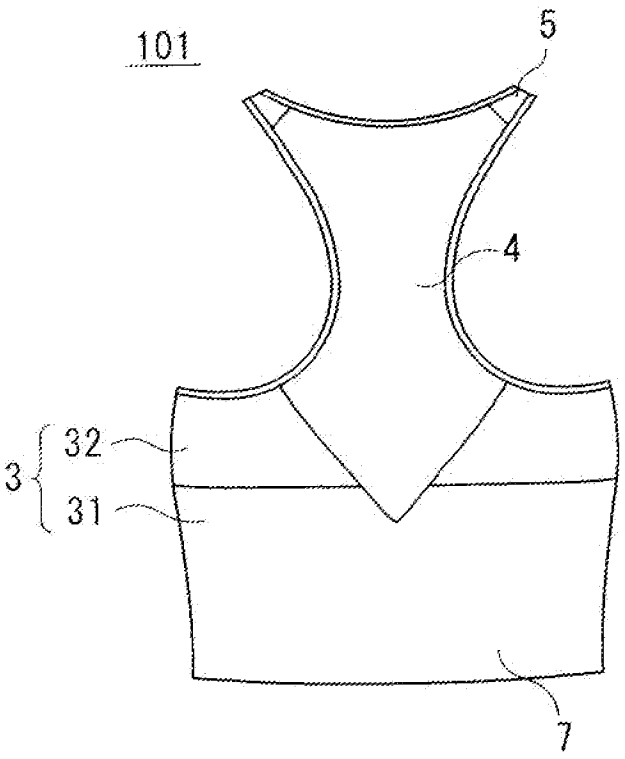
FIG. 18B is a rear view of the clothes.
Figure 18A:
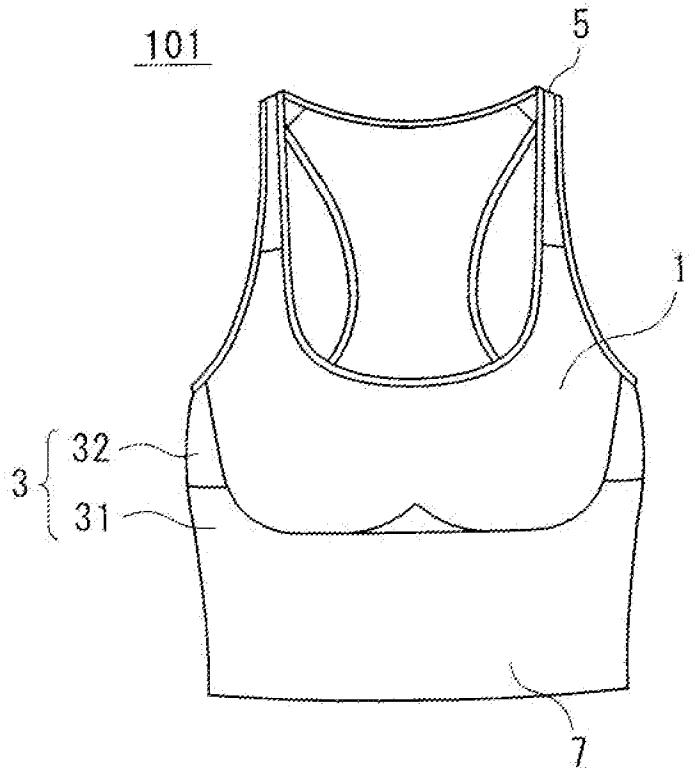
FIG. 18A is a front view illustrating the clothes.

FIG. 18A is a front view illustrating clothes 101, and FIG. 18B is a rear view of the clothes 101. The lower support portion 31 of the clothes 101 includes the part 38 extending to the center on the front side of the chest, and has shape going around the chest. Also, the lower support portion 31 has a configuration of extending in the lengthwise direction to the naval of the body. The portion of the lower support portion 31 covering from the lower side of the wearer's chest to the naval of the body is the body-covering portion 7. The dimension in the lengthwise direction of the lower support portion 31 may be short or long. For example, the body-covering portion 7 may extend to the leg, and the clothes 101 may be one-piece dress or jumpsuit type pants.

Figure 19B:
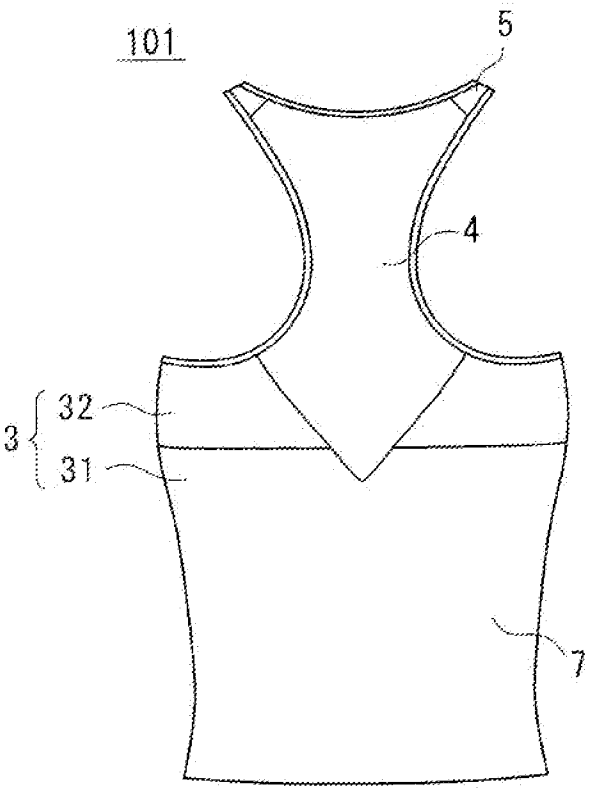
FIG. 19B is a rear view of the clothes.
Figure 19A:
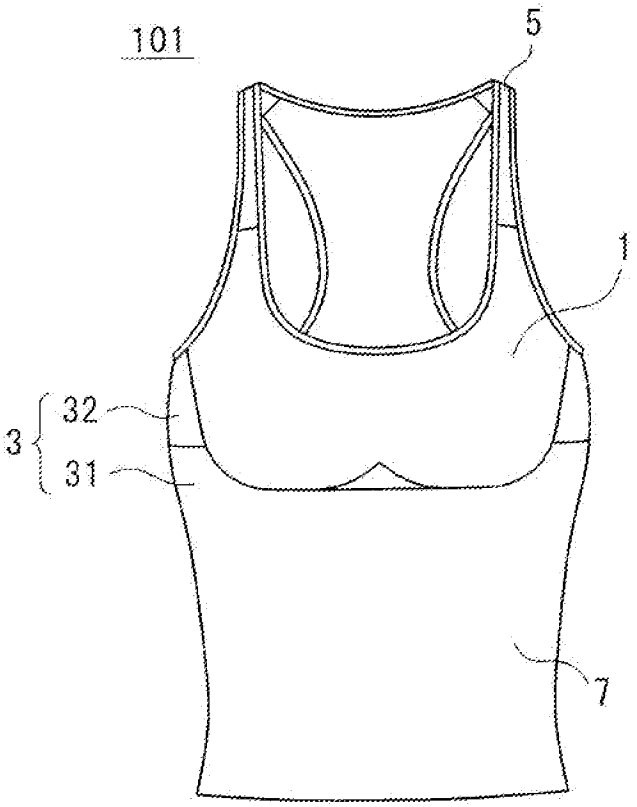
FIG. 19A is a front view of the clothes according to a modification example.

FIG. 19A is a front view illustrating clothes 101 according to a modification example, and FIG. 19B is a rear view of the clothes 101. The lower support portion 31 of the clothes 101 according to the modification example includes the part 38 extending to the center on the front side of the chest, and has shape going around the chest. Also, the lower support portion 31 has a configuration of extending in the lengthwise direction to the waist of the body. The portion of the lower support portion 31 covering from the lower side of the wearer's chest to the naval of the body is the body-covering portion 7. The dimension in the lengthwise direction of the lower support portion 31 may be short or long. For example, the body-covering portion 7 may extend to the leg, and the clothes 101 may be one-piece dress or jumpsuit type pants.

Figure 20B:
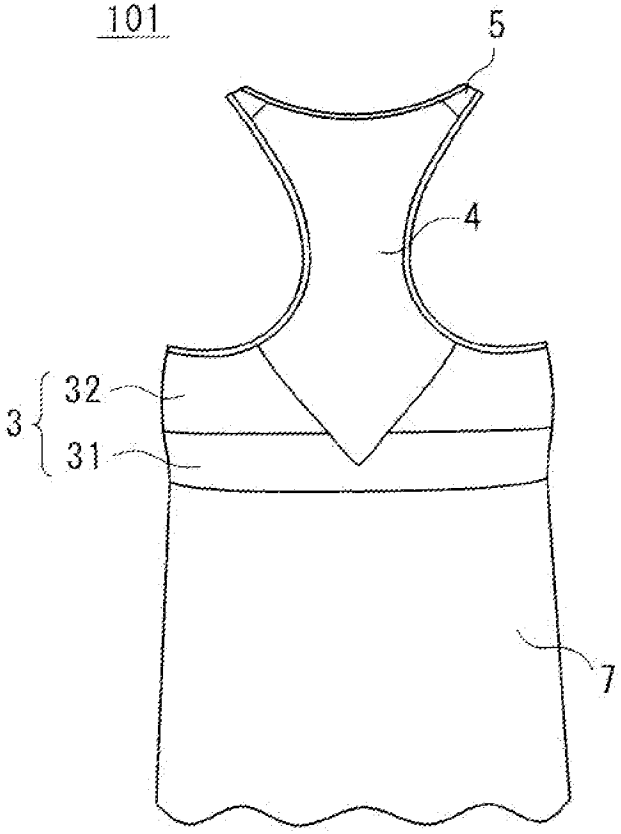
FIG. 20B is a rear view of the clothes.
Figure 20A:
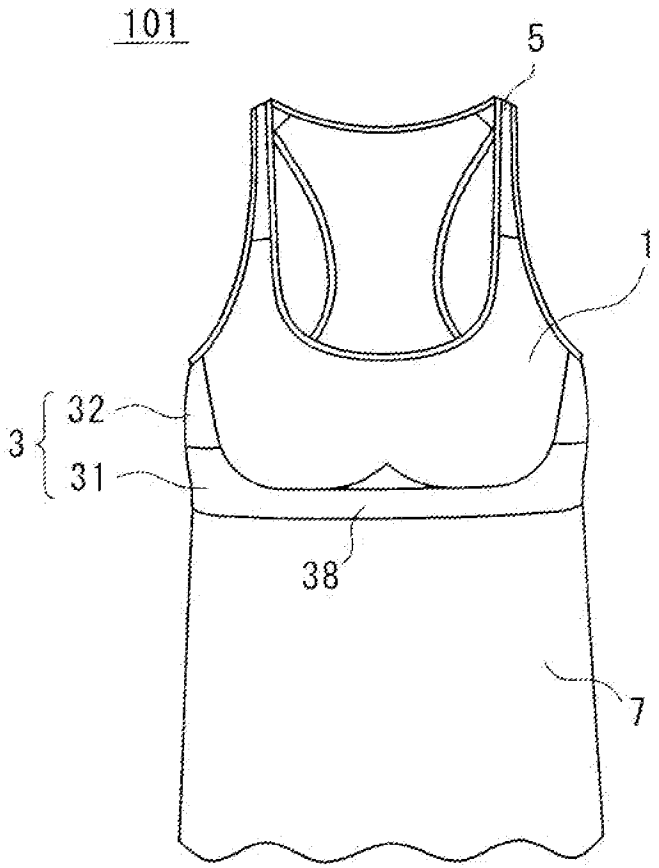
FIG. 20A is a front view of the clothes according to another modification example.

FIG. 20A is a front view illustrating clothes 101 according to another modification example, and FIG. 20B is a rear view of the clothes 101. The lower support portion 31 of the clothes 101 according to the other modification example includes the part 38 extending to the center on the front side of the chest, and has shape going around the chest. Also, the clothes 101 has a configuration in which the body-covering portion 7 which is a different part of the lower support portion 31 is connected to the lower portion of the lower support portion 31. The dimension in the lengthwise direction of the body-covering portion 7 may be short or long. For example, the body-covering portion 7 may extend to the leg, and the clothes 101 may be one-piece dress or jumpsuit type pants. The dimension in the lengthwise direction of the lower support portion 31 may be short or long. For example, the body-covering portion 7 may extend to the leg, and the clothes 101 may be one-piece dress or jumpsuit type pants.

Figure 21B:
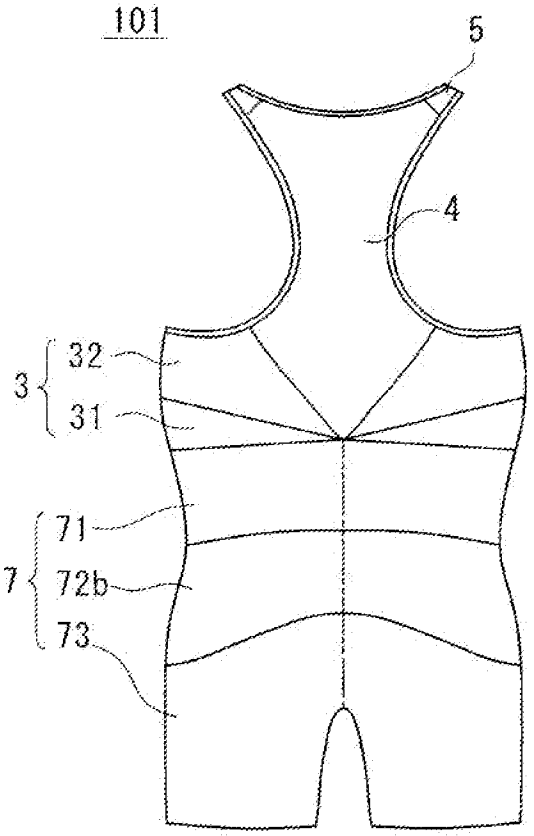
FIG. 21B is a rear view of the clothes.
Figure 21A:
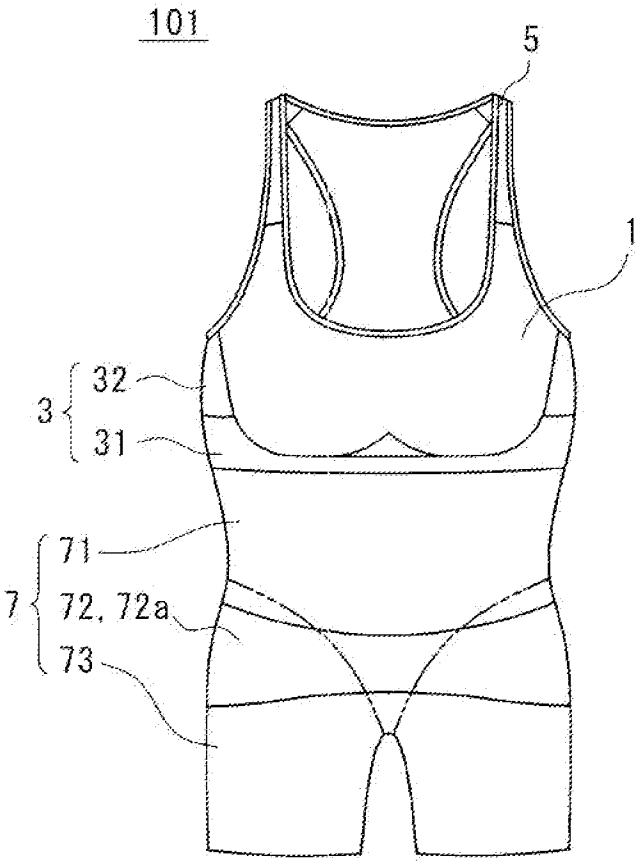
FIG. 21A is a front view of the clothes according to a still other modification example.

FIG. 21A is a front view illustrating clothes 101 according to a still other modification example, and FIG. 21B is a rear view of the clothes 101. The lower support portion 31 of the clothes 101 according to the other modification example includes the part 38 extending to the center on the front side of the chest, and has shape going around the chest. Also, the clothes 101 has a configuration in which the body-covering portion 7 which is a different part of the lower support portion 31 is connected to the lower portion of the lower support portion 31. The dimension in the lengthwise direction of the lower support portion 31 is getting small toward the center of the wearer's back surface, and the lower support portion 31 may be connected or disconnected in the wearer's back surface.

The body-covering portion 7 includes a body support portion 71 arranged from the lower side of the chest to the upper side of the waist, a waist support portion 72 arranged at the waist, and a thigh support portion 73 arranged from the lower side of the waist to the thigh. The clothes 101 is jumpsuit type pants. Since the waist support portion 72 is configured in which the waist-front support portion 72*a* is arranged at the position lower than the waist-back support portion 72*b*, the waist support portion 72 supports the wearer's waist to be frontward tilt attitude. The two-dot line described in the figure shows an example of the seam, and the body-covering portion 7 is formed by sewing the parts which are divided into at the seam described in the figure and the seam located in the body-side and the inside of the thigh. The parts composition of the body-covering portion 7 is not restricted to the example described in the figure.

Figure 22A:
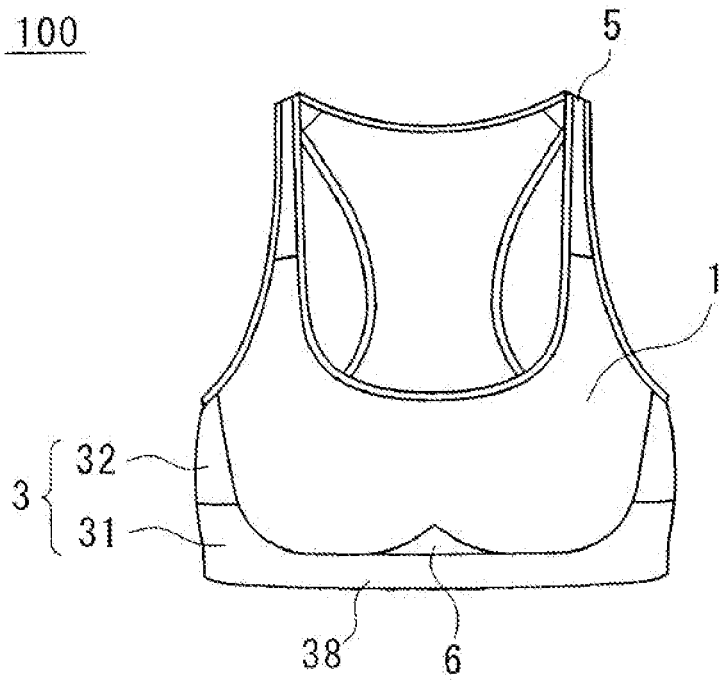
FIG. 22A is a front view of the brassiere according to a modification example.
Figure 22B:
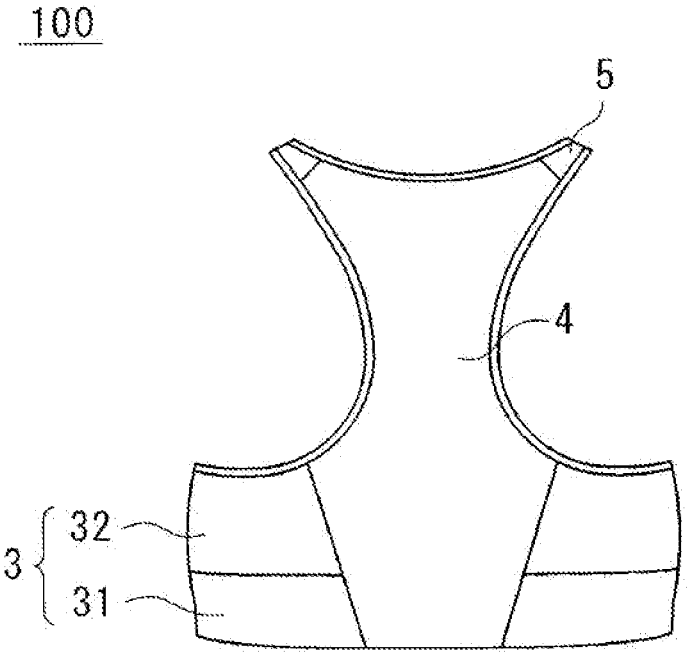
FIG. 22B is a rear view of the brassiere.

FIG. 22A is a front view illustrating a brassiere 100 according to a modification example, and FIG. 22B is a rear view of the brassiere 100. The back support portion 4 of the brassiere 100 according to the other modification example extends to the bottom edge of the brassiere 100, and the lower support portion 31 is connected to both side of the back support portion 4. Since the stretching property in the lengthwise direction of the back support portion 4 is lower than that of the body-side support portion 3, the back support portion 4 has excellent supporting property in the wearer's back side and exhibit excellent holding property of the breasts in the lengthwise direction with the breast support portion 1 and the shoulder strap portion 5.

Figure 23B:
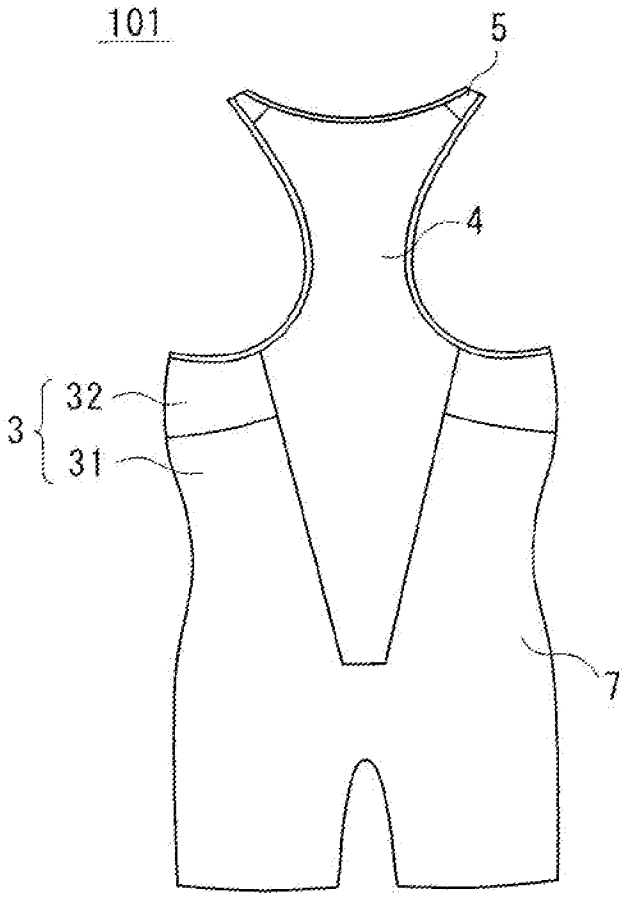
FIG. 23B is a rear view of the clothes.
Figure 23A:
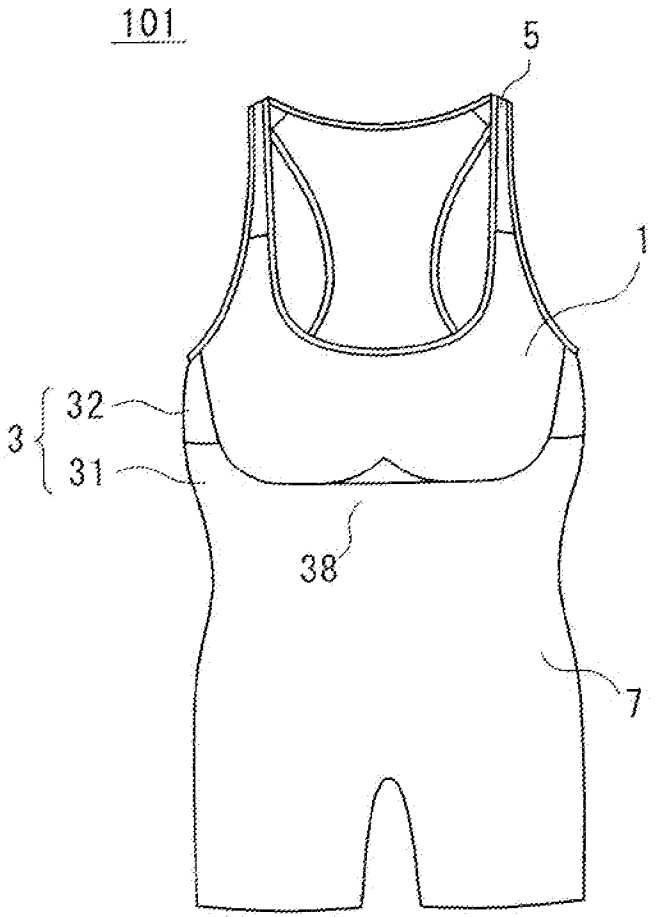
FIG. 23A is a front view of the clothes according to a still other modification example.

FIG. 23A is a front view illustrating clothes 101 according to a still other modification example, and FIG. 23B is a rear view of the clothes 101. The lower support portion 31 of the clothes 101 according to the other modification example includes the part 38 extending to the center on the front side of the chest, and has shape going around the chest. Also, the clothes 101 has a configuration in which the lower support portion 31 extends to the lower side and forms the body-covering portion 7. The body-covering portion 7 covers the wearer's body, waist and thigh. The clothes 101 is jumpsuit type pants. The dimension in the lengthwise direction of the lower support portion 31 may be short or long. For example, the body-covering portion 7 may extend to the leg, and the clothes 101 may be one-piece dress.

Since the back support portion 4 extends to the waist in the back surface of the body, the clothes 101 has excellent supporting property in the wearer's back side. The clothes 101 may be one-piece dress with the lower side of the crotch thereof to be made as skirt-shaped. The clothes 101 may be jumpsuit type pants. Also, the clothes 101 may have a configuration in which the lower support portion 31 is arranged at the chest and the portions of the wearer's body lower than the chest, waist and thigh are made with different parts of the lower support portion 31.

Figure 24B:
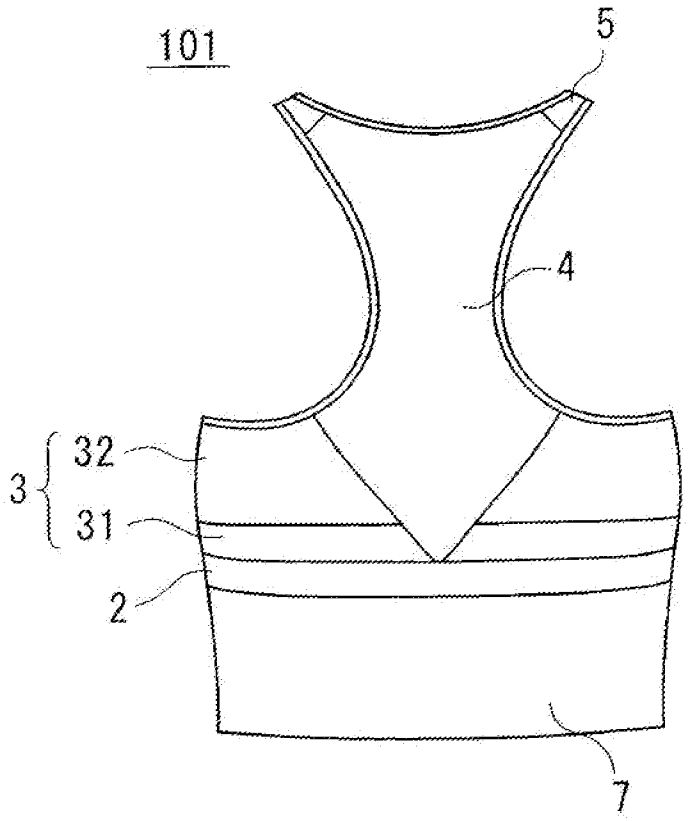
FIG. 24B is a rear view of the clothes.
Figure 24A:
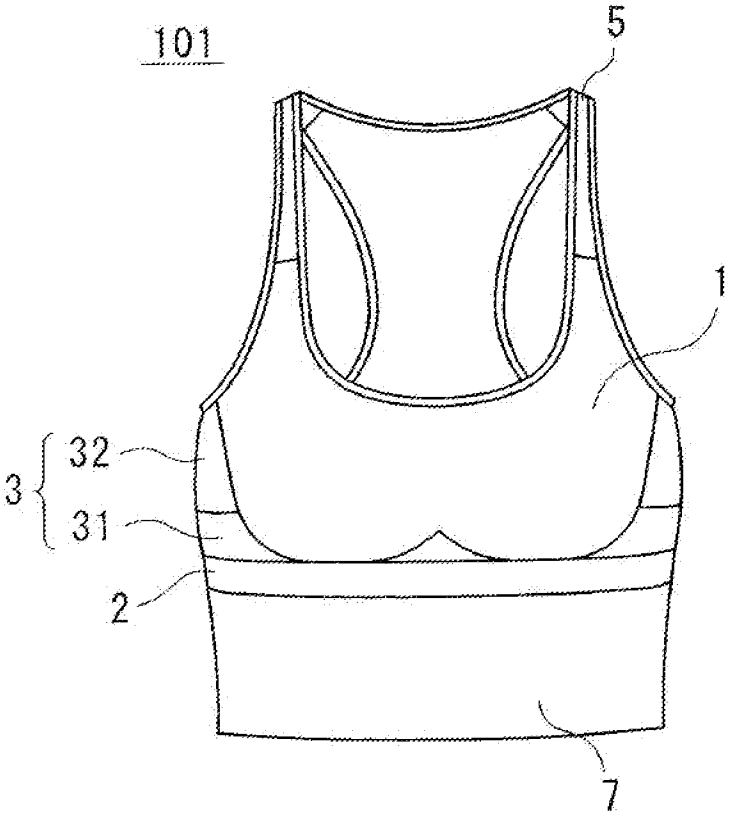
FIG. 24A is a front view of the clothes according to a still other modification example.

FIG. 24A is a front view illustrating clothes 101 according to a still other modification example, and FIG. 24B is a rear view of the clothes 101. The clothes 101 according to the other modification example includes the belt portion 2 in a similar manner to the first embodiment. The clothes 101 has a configuration in which the body-covering portion 7 is arranged at the lower side of the belt portion 2 to cover the wearer's body. The dimension in the lengthwise direction of the body-covering portion 7 may be short or long. For example, the body-covering portion 7 may extend to the waist or the leg, and the clothes 101 may be one-piece dress or jumpsuit type pants.

Figure 25B:
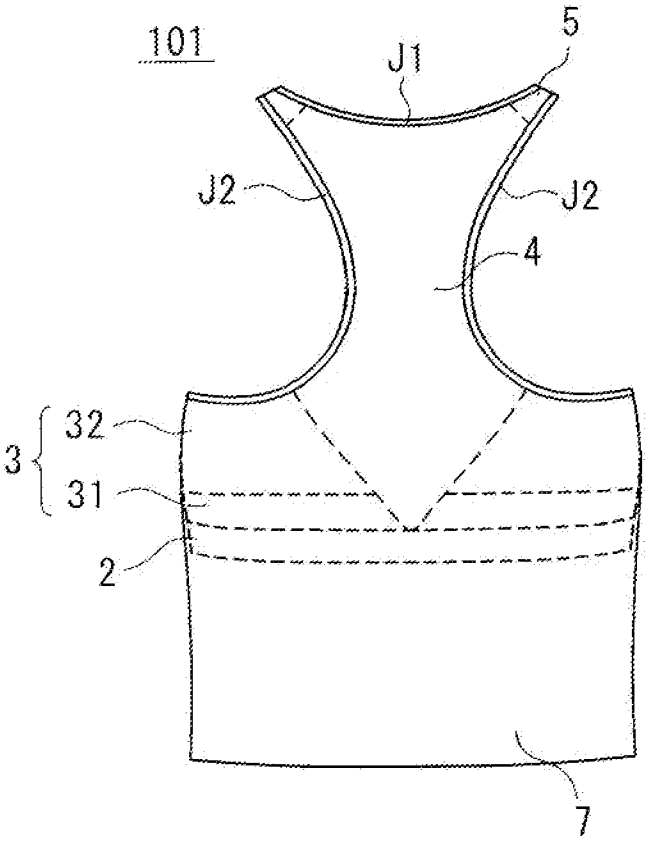
FIG. 25B is a rear view of the clothes.
Figure 25A:
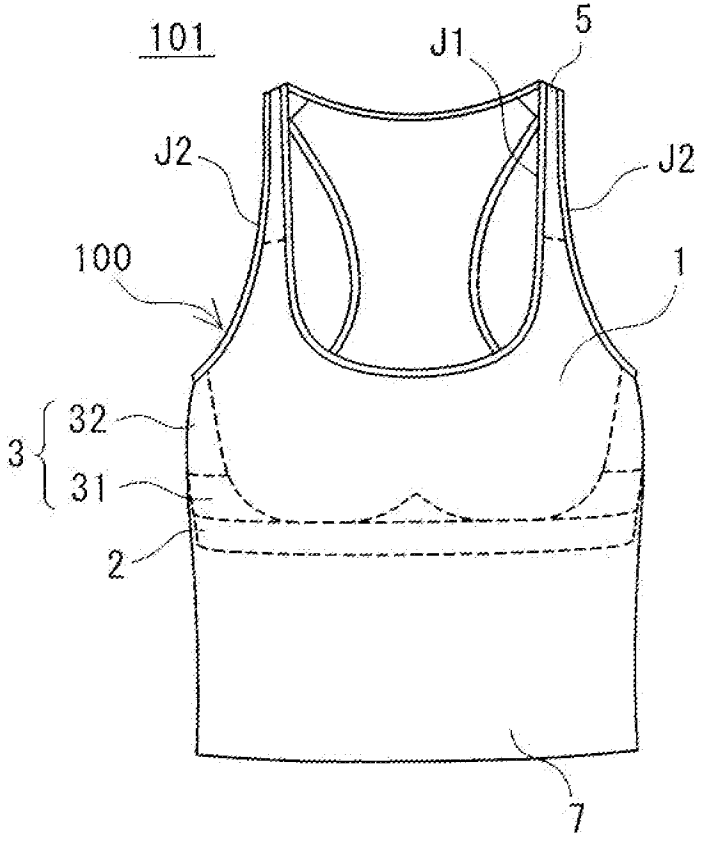
FIG. 25A is a front view of the clothes according to a still other modification example.

FIG. 25A is a front view illustrating clothes 101 according to a still other modification example, and FIG. 25B is a rear view of the clothes 101. The clothes 101 according to the other modification example has a configuration in which the body-covering portion 7 is arranged to cover the surface of the brassiere 100 described in the first embodiment. The body-covering portion 7 is connected to the neckline portion J1 and the armhole portion J2 and covers the surface of the brassiere 100. Also, the body-covering portion 7 extends to the lower side of the chest and covers the body of the wearer. The dimension in the lengthwise direction of the body-covering portion 7 may be short or long. For example, the body-covering portion 7 may extend to the waist or the leg, and the clothes 101 may be one-piece dress or jumpsuit type pants.

The brassiere 100 may have a configuration which is described based on FIGS. 17A and 17B. The brassiere 100 may have a configuration which is described based on FIGS. 22A and 22B. The body-covering portion 7 may partially be connected to the neckline portion J1 and the armhole portion J2. The body-covering portion 7 may be connected to the other portion except the neckline portion J1 and the armhole portion J2.

Figure 26B:
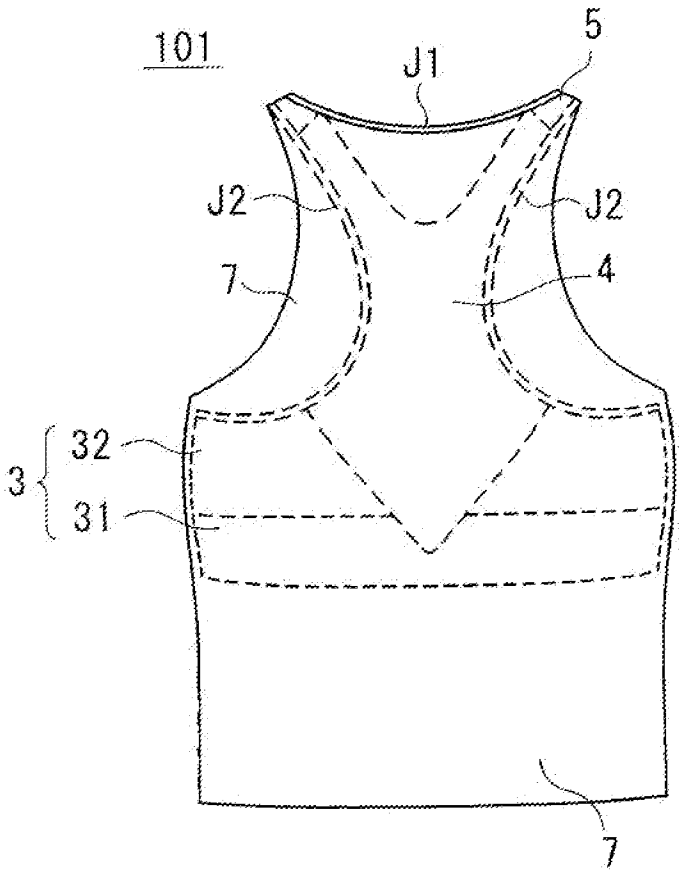
FIG. 26B is a rear view of the clothes.
Figure 26A:
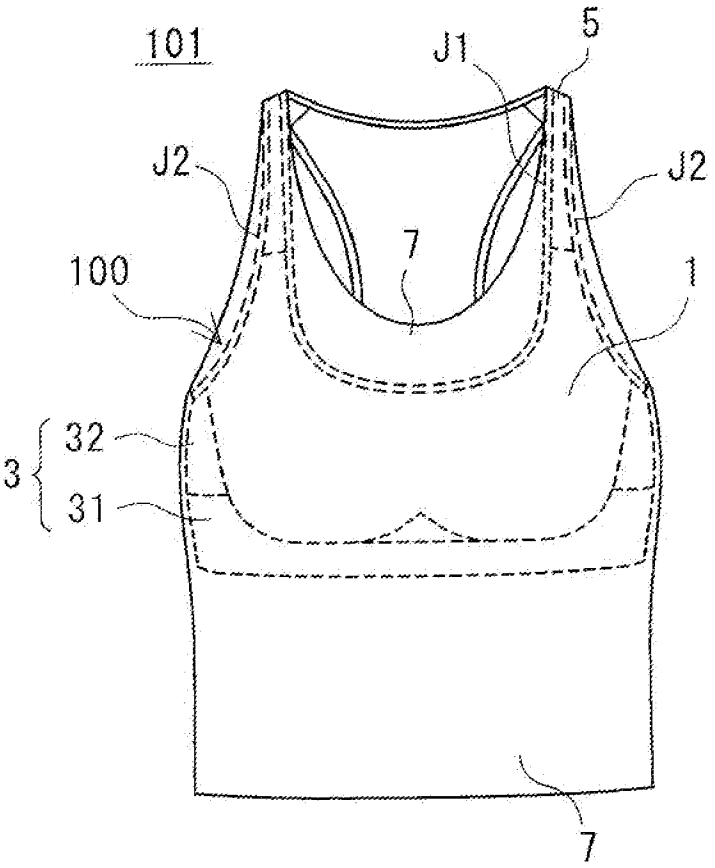
FIG. 26A is a front view of the clothes according to a still other modification example.

FIG. 26A is a front view illustrating clothes 101 according to a still other modification example, and FIG. 26B is a rear view of the clothes 101. The clothes 101 according to the other modification example has a configuration in which the body-covering portion 7 is arranged to cover the surface of the brassiere 100 described based on the FIGS. 17A and 17B. The body-covering portion 7 is connected to the neckline portion J1 and the armhole portion J2 and covers the surface of the brassiere 100. Also, the body-covering portion 7 extends to the lower side of the chest and covers the body of the wearer. The body-covering portion 7 may be connected to the other portion except the neckline portion J1 and the armhole portion J2. The body-covering portion 7 is formed wide in the circumference direction to overhang from the brassiere 100 at the neckline portion J1 and the armhole portion J2. The dimension in the lengthwise direction of the body-covering portion 7 may be short or long. For example, the body-covering portion 7 may extend to the waist or the leg, and the clothes 101 may be one-piece dress or jumpsuit type pants.

The brassiere 100 may have a configuration which is described in the first embodiment. The brassiere 100 may have a configuration which is described based on FIGS. 22A and 22B. The body-covering portion 7 may partially be connected to the neckline portion J1 and the armhole portion J2. The body-covering portion 7 may be connected to the other portion except the neckline portion J1 and the armhole portion J2.

Figure 27B:
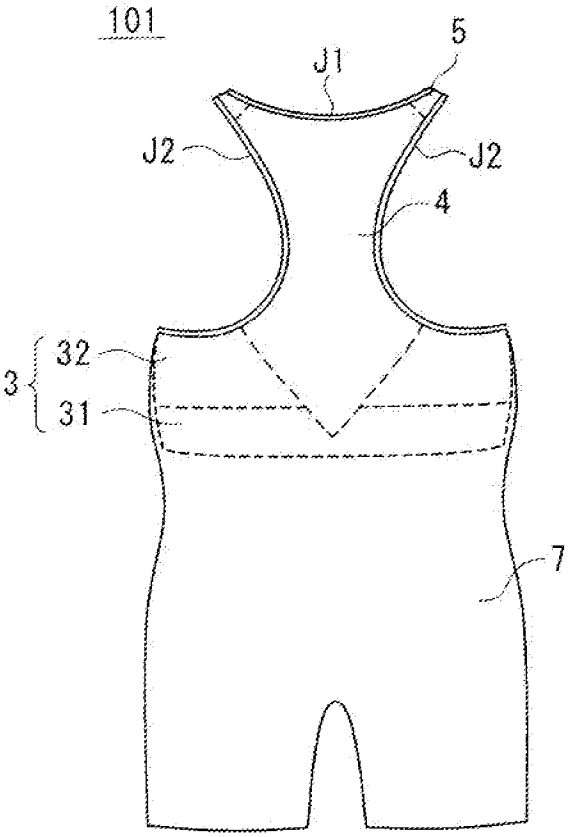
FIG. 27B is a rear view of the clothes.
Figure 27A:
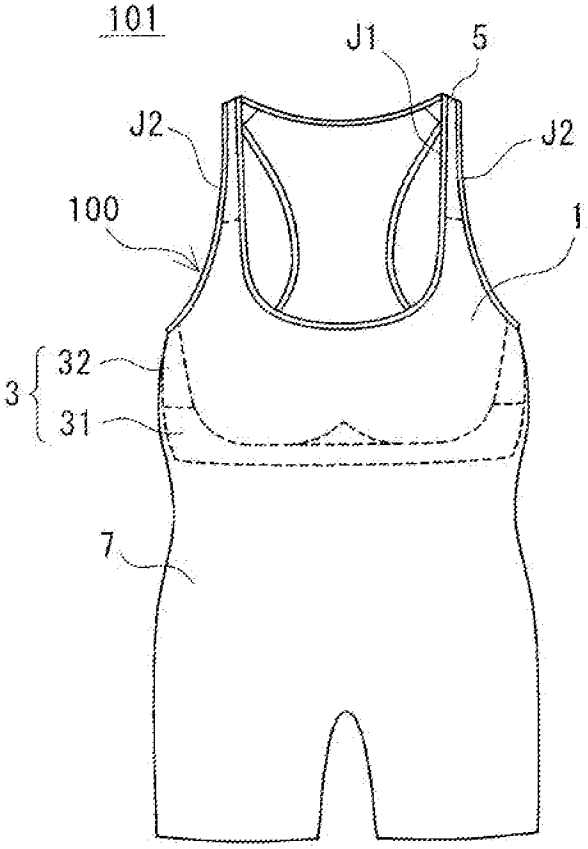
FIG. 27A is a front view of the clothes according to a still other modification example.

FIG. 27A is a front view illustrating clothes 101 according to a still other modification example, and FIG. 27B is a rear view of the clothes 101. The clothes 101 according to the other modification example has a configuration in which the body-covering portion 7 is arranged to cover the surface of the brassiere 100 described based on FIGS. 17A and 17B. The body-covering portion 7 is connected to the neckline portion J1, the armhole portion J2 and the like and covers the surface of the brassiere 100. Also, the body-covering portion 7 extends to the lower side of the chest and covers the body of the wearer. The body-covering portion 7 has a configuration in which the part not covering the back support portion 4 exists. The part not covering by the body-covering portion is not limited to the back support portion 4. The dimension in the lengthwise direction of the body-covering portion 7 may be short or long. For example, the body-covering portion 7 may extend to the waist or the leg. The clothes 101 may be one-piece dress or jumpsuit type pants.

The brassiere 100 may have a configuration which is described in the first embodiment. The brassiere 100 may have a configuration which is described based on FIGS. 22A and 22B. The body-covering portion 7 may partially be connected to the neckline portion J1 and the armhole portion J2. The body-covering portion 7 may be connected to the other portion except the neckline portion J1 and the armhole portion J2.

Figure 28B:
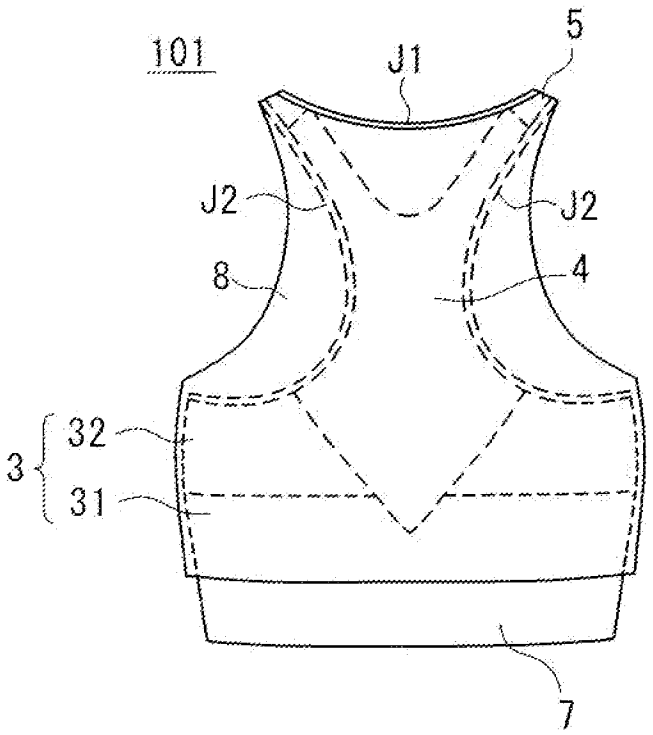
FIG. 28B is a rear view of the clothes.
Figure 28A:
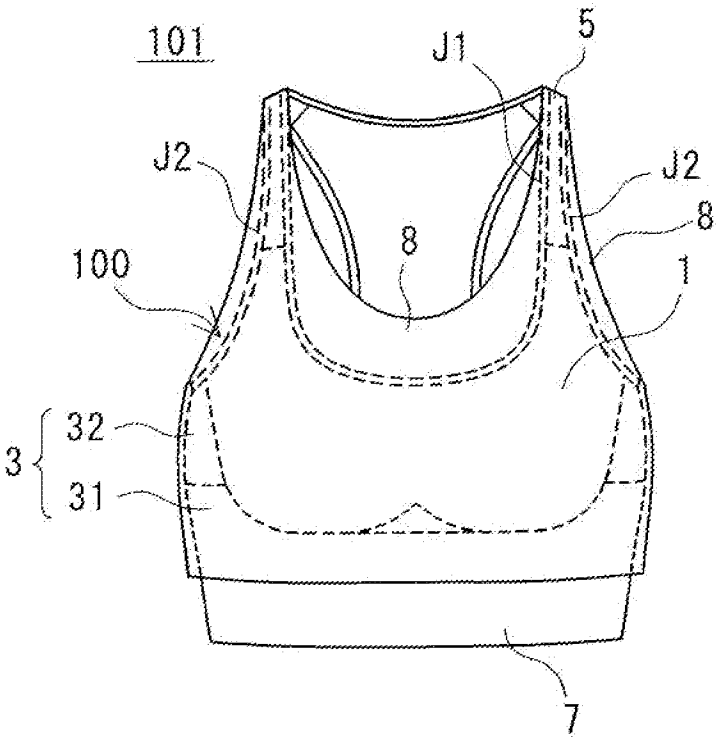
FIG. 28A is a front view of the clothes according to a still other modification example.

FIG. 28A is a front view illustrating clothes 101 according to a still other modification example, and FIG. 28B is a rear view of the clothes 101. The clothes 101 according to the other modification example has a configuration in which the chest-covering portion 8 is arranged to cover the surface of the chest of the clothes 101 described based on FIGS. 18A and 18B. The chest-covering portion 8 is connected to the neckline portion J1, the armhole portion J2 and the like and covers the surface of the breast support portion 1, body-side support portion 3 and the back support portion 4. The body-covering portion 7 is formed by extending the lower support portion 31 to the lower side to cover the body of the wearer. The chest-covering portion 8 extends to the position higher than the lower edge of the body-covering portion 7.

The clothes 101 may have a configuration including the belt portion 2 described in the first embodiment and including the different part that covers the body of the wearer in the lower side of the belt support portion 2. The dimension in the lengthwise direction of the body-covering portion 7 may be short or long. For example, the body-covering portion 7 may extend to the waist or the leg. The clothes 101 may be one-piece dress or jumpsuit type pants. The chest-covering portion 8 may partially be connected to the neckline portion J1 and the armhole portion J2. The chest-covering portion 8 may be connected to the brassiere 100 at the other portion except the neckline portion J1 and the armhole portion J2.

The chest-covering portion 8 may be included in the clothes 101 which is described based on FIGS. 21A and 21B. The chest-covering portion 8 may be included in the clothes 101 which is described based on FIGS. 23A and 23B. The chest-covering portion 8 may partially be connected to the neckline portion J1 and the armhole portion J2. The chest-covering portion 8 may be connected to the brassiere 100 at the other portion except the neckline portion J1 and the armhole portion J2. The chest-covering portion 8 is formed wide in the circumferential direction to stick out of the breast support portion 1 and the back support portion 4 at the neckline portion J1 and the armhole portion J2. The chest-covering portion 8 is formed by the equivalent dimension in the circumferential direction to that of the breast support portion 1 and the back support portion 4 at the neckline portion J1 and the armhole portion J2.

Forth Embodiment

Figure 29:
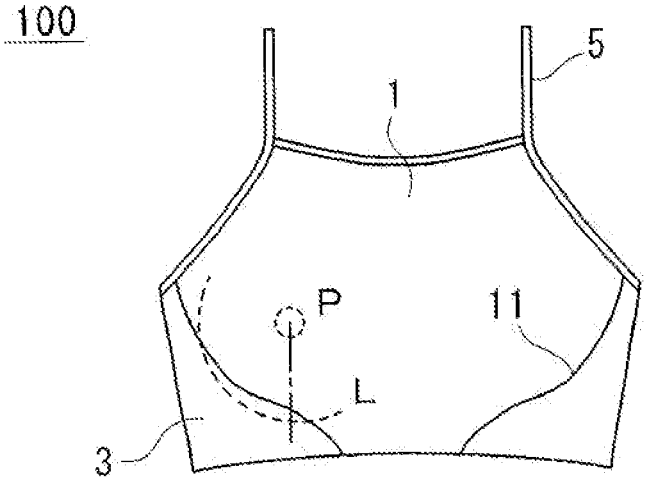
FIG. 29 is a front view illustrating the brassiere according to a fourth embodiment.

FIG. 29 is a front view illustrating a brassiere 100 according to a Forth embodiment. The brassiere 100 according to the Forth embodiment includes the breast support portion 1, the body-side support portion 3, the back support portion 4, and the shoulder strap portion 5 in a similar manner to the brassiere 100 described based on FIG. 14A in the second embodiment, and has a configuration in which a belt portion 2 is dispensed with. The back side and the body-side of the brassiere 100 has a configuration in a similar manner to the brassiere 100 described based on FIGS. 10A and 10B, so that an explanation is omitted for brevity of the description.

The brassiere 100 has a configuration in a similar manner to the brassiere 100 described in the second embodiment, in which the body-side support portion 3 having a high stretching property in the lengthwise direction is provided to extend inside a verge line L of the breasts and is arranged toward the lower side of the center of the chest in the verge line L. Also, the breast support portion 1 has a low stretching property in the lengthwise direction and has a higher stretching property in the circumferential direction than that in the lengthwise direction. Also, the other examples of the brassiere 100 described in the second embodiment have a configuration in which a belt portion 2 is dispensed with.

For example, when a wearer moves her body to do training such as exercise and yoga, the brassiere 100 fits the wearer's chest to facilitate movement of her body and suppresses displacement at the wearer's chest, in a similar manner to the brassiere 100 described in the second embodiment. In particular, since the brassiere 100 reduces inhibition of stretch in the lengthwise direction of the skin around the verge line, particularly the skin in the region from the lower portion of the breasts inside the verge line to the verge line lower side, the brassiere 100 has a configuration that is suitable for wear for sports such as swimming requiring a vigorous arm raising movement.

Figure 30:
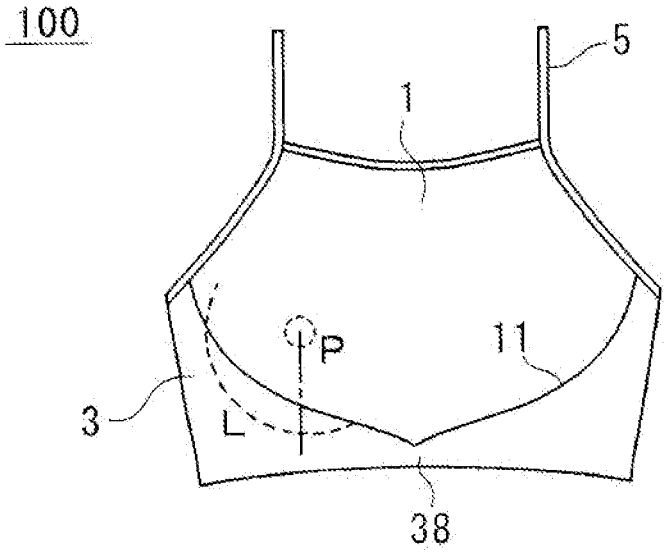
FIG. 30 is a front view illustrating the brassiere according to a modification embodiment.

FIG. 30 is a front view illustrating a brassiere 100 according to a modification example. The body-side support portion 3 of the brassiere 100 according to the modification example includes the part 38 extending to the center on the front side of the chest, and is connected to the lower portion of the breast support portion 1. Since the body-side support portion 31 extending to the center on the front side of the chest, the brassiere 100 fits the wearer's chest and suppresses displacement at the wearer's chest mainly in the circumferential direction.

Figure 31:
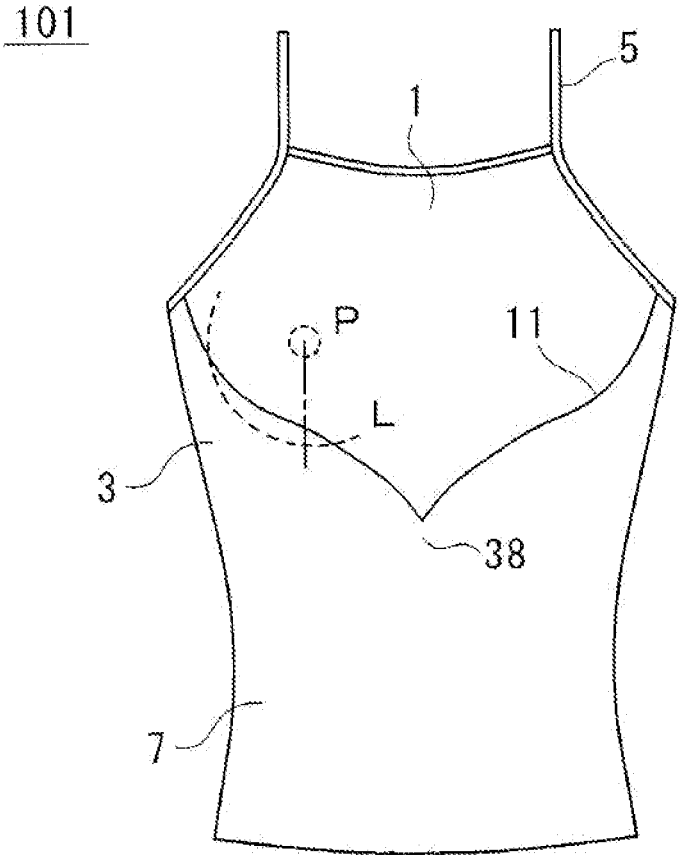
FIG. 31 is a front view illustrating the clothes.

FIG. 31 is a front view illustrating clothes 101. The body-side support portion 3 of the clothes 101 includes the part 38 extending to the center on the front side of the chest, and is connected to the lower portion of the breast support portion 1. Also, the body-side support portion 3 has a configuration of extending in the lengthwise direction to the waist. The portion of the body-side support portion 3 covering from the lower side of the wearer's chest to the waist of the body is the body-covering portion 7. The dimension in the lengthwise direction of the body-covering portion 7 may be short or long and may extend to the waist or the leg for example. The clothes 101 may be one-piece dress or jumpsuit type pants.

Figure 32:
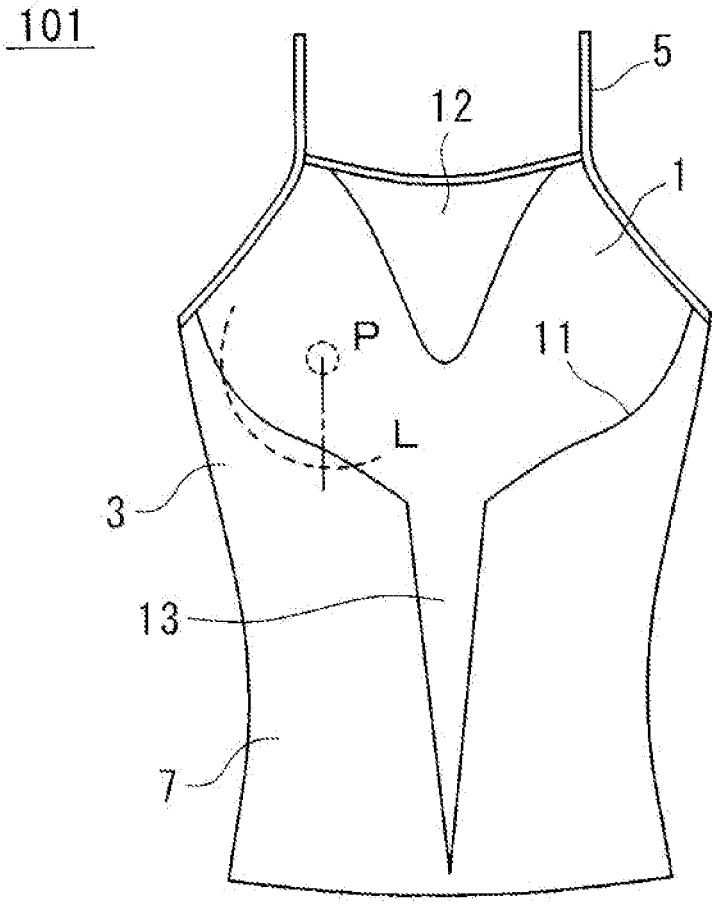
FIG. 32 is a front view illustrating the clothes according to a modification embodiment.

FIG. 32 is a front view illustrating clothes 101 according to a modification example. The breast support portion 1 of the clothes 101 according to the modification example includes the front-center support portion 13 extending to the waist in the center of the front side of the wearer, and suppresses displacement of the breast support portion 1 to the lengthwise direction. At the upper center portion of the breast support portion 1, a different material from that for the breast support portion 1 is arranged at a region 12 circled by an inclined line going downward as the line approaches the center. For example, an equivalent material to the body-side support portion 3 may be arranged in the region 12 to heighten the stretching property in the lengthwise direction.

The portion of the body-side support portion 3 covering from the lower side of the wearer's chest to the waist of the body is the body-covering portion 7. The dimension in the lengthwise direction of the body-covering portion 7 may be short or long and may extend to the waist or the leg for example.

Figure 33:
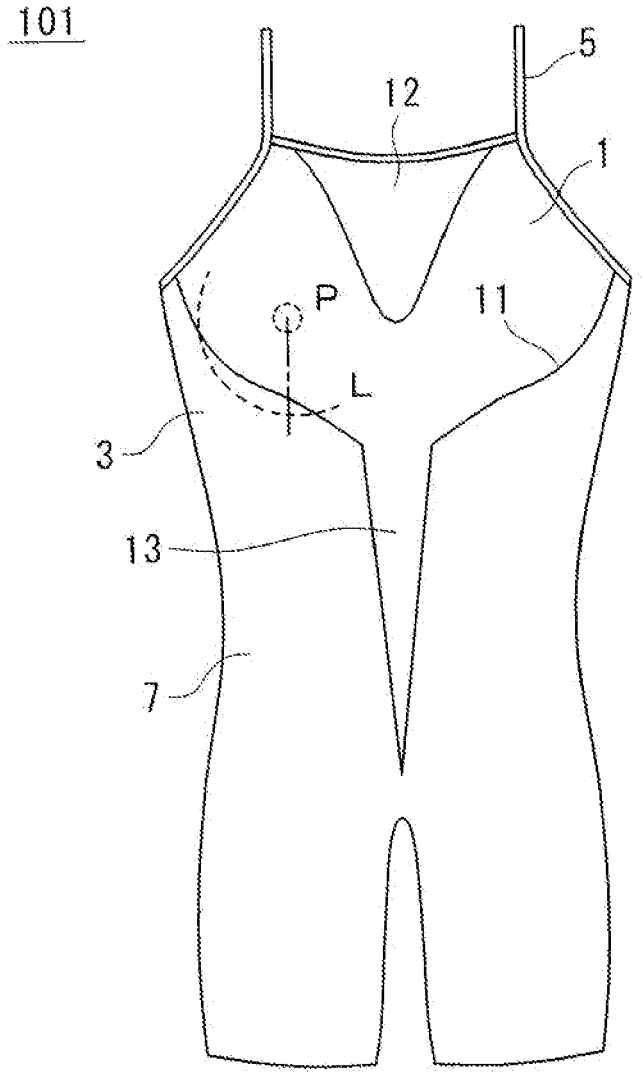
FIG. 33 is a front view illustrating the clothes according to another modification embodiment.

FIG. 33 is a front view illustrating clothes 101 according to another modification example. The breast support portion 1 of the clothes 101 according to the modification example includes the region 12 and the front-center support portion 13 in a similar manner to the clothes 101 described in FIG.

32. The clothes 101 has a configuration in which the body-side support portion 3 extends to the leg and forms the body-covering portion 7, and is jumpsuit type pants. The clothes 101 may be one-piece dress.

Figure 34:
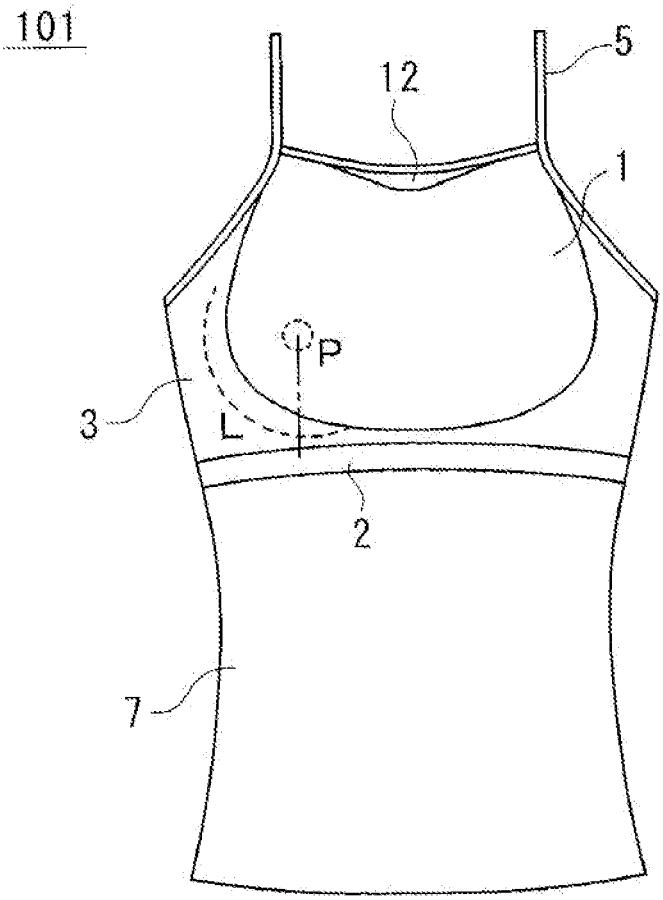
FIG. 34 is a front view illustrating the clothes according to a still other modification embodiment.

FIG. 34 is a front view illustrating clothes 101 according to a still other modification example. The clothes 101 according to the other modification example includes the body-covering portion 7 in the brassiere 100 described in FIG. 16A. The body-covering portion 7 is made with different parts of the body-side support portion 3 and is connected to the lower portion of the belt portion 2. The body-covering portion 7 covers from the lower side of the wearer's chest to the waist. The body-covering portion 7 may be short or long and may extend to the leg.

Figure 35:
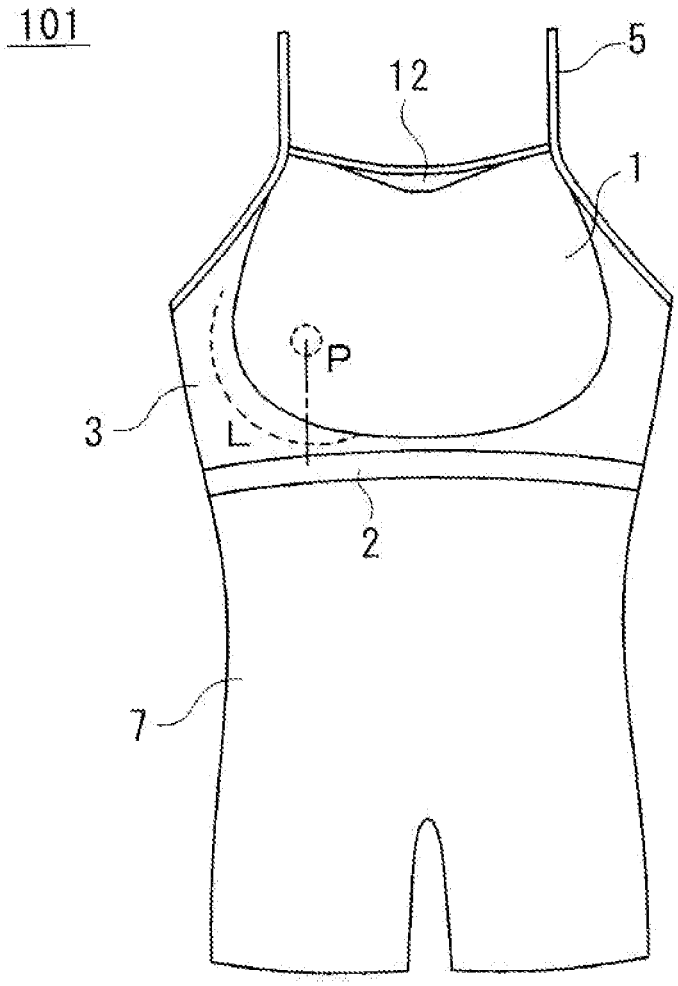
FIG. 35 is a front view illustrating the clothes according to a still other modification embodiment.

FIG. 35 is a front view illustrating clothes 101 according to a still other modification example. The clothes 101 according to the other modification example includes the body-covering portion 7 in the brassiere 100 described in FIG. 16A. The body-covering portion 7 is made with different parts of the body-side support portion 3 and is connected to the lower portion of the belt portion 2. The body-covering portion 7 covers to the wearer's leg, and the clothes 101 is jumpsuit type pants. The clothes 101 may be one-piece dress.

Figure 36:
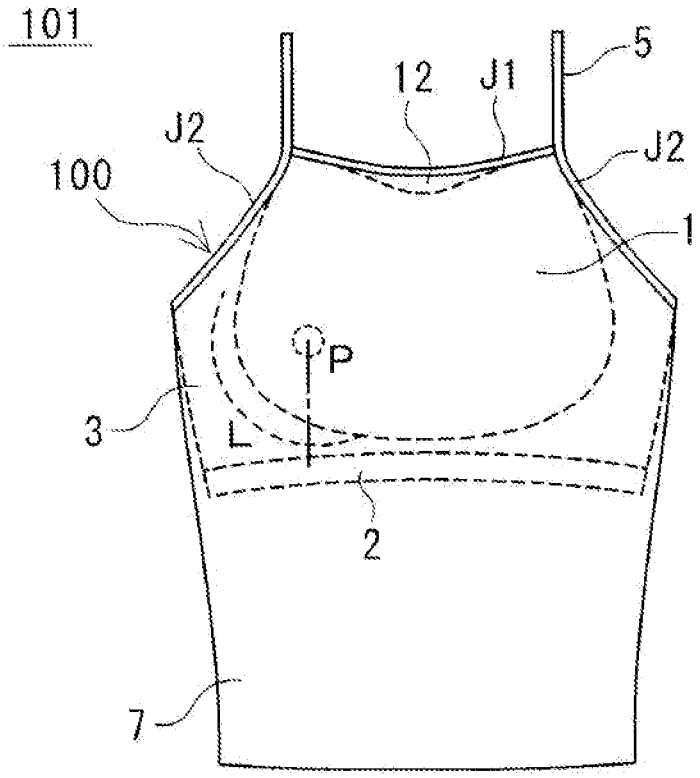
FIG. 36 is a front view illustrating the clothes according to a still other modification embodiment.

FIG. 36 is a front view illustrating clothes 101 according to a still other modification example. The clothes 101 according to the other modification example has a configuration in which the body-covering portion 7 is arranged to cover the surface of the brassiere 100 described based on FIG. 16A. The body-covering portion 7 is connected to the neckline portion J1 and the armhole portion J2 and covers the surface of the brassiere 100. Also, the body-covering portion 7 extends to the lower side of the chest and covers the body of the wearer. The dimension in the lengthwise direction of the body-covering portion 7 may be short or long. For example, the body-covering portion 7 may extend to the waist or the leg. The body-covering portion 7 may partially be connected to the neckline portion J1 and the armhole portion J2. The body-covering portion 7 may be connected to the brassiere 100 at the other portion except the neckline portion J1 and the armhole portion J2.

Figure 37:
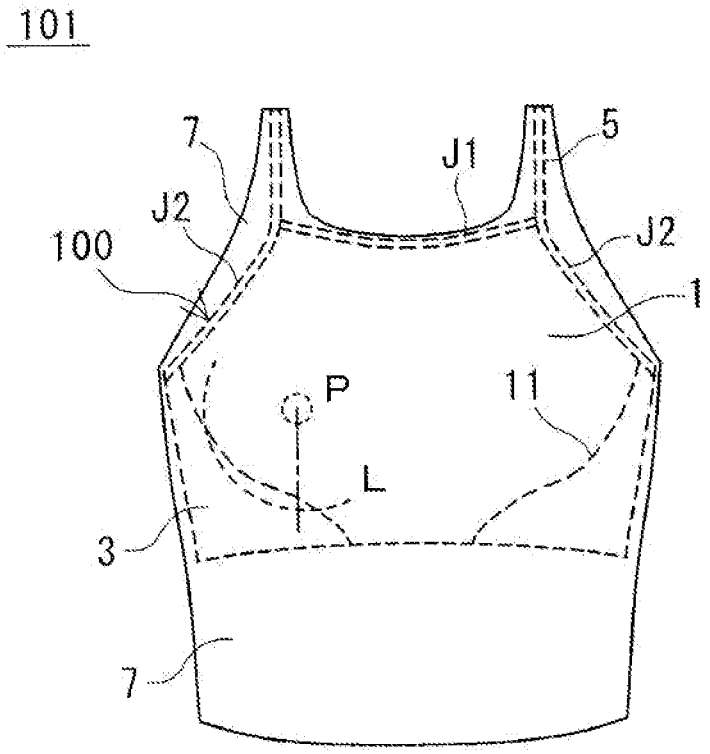
FIG. 37 is a front view illustrating the clothes according to a still other modification embodiment.

FIG. 37 is a front view illustrating clothes 101 according to a still other modification example. The clothes 101 according to the other modification example has a configuration in which the body-covering portion 7 is arranged to cover the surface of the brassiere 100 described based on FIG. 29. The body-covering portion 7 is connected to the shoulder strap portion 5, the neckline portion J1, the armhole portion J2 and the like, and covers the surface of the brassiere 100. Also, the body-covering portion 7 extends to the lower side of the chest and covers the body of the wearer. The body-covering portion 7 is formed wide in the circumferential direction to stick out of the brassiere 100 at the shoulder strap portion 5, the neckline portion J1 and the armhole portion J2. The dimension in the lengthwise direction of the body-covering portion 7 may be short or long. For example, the body-covering portion 7 may extend to the waist or the leg, and the clothes 101 may be one-piece dress or jumpsuit type pants. The body-covering portion 7 may partially be connected to the shoulder strap portion 5, the neckline portion J1 and the armhole portion J2. The body-covering portion 7 may be connected to the brassiere 100 at the other portion except the shoulder strap portion 5, the neckline portion J1 and the armhole portion J2.

Figure 38:
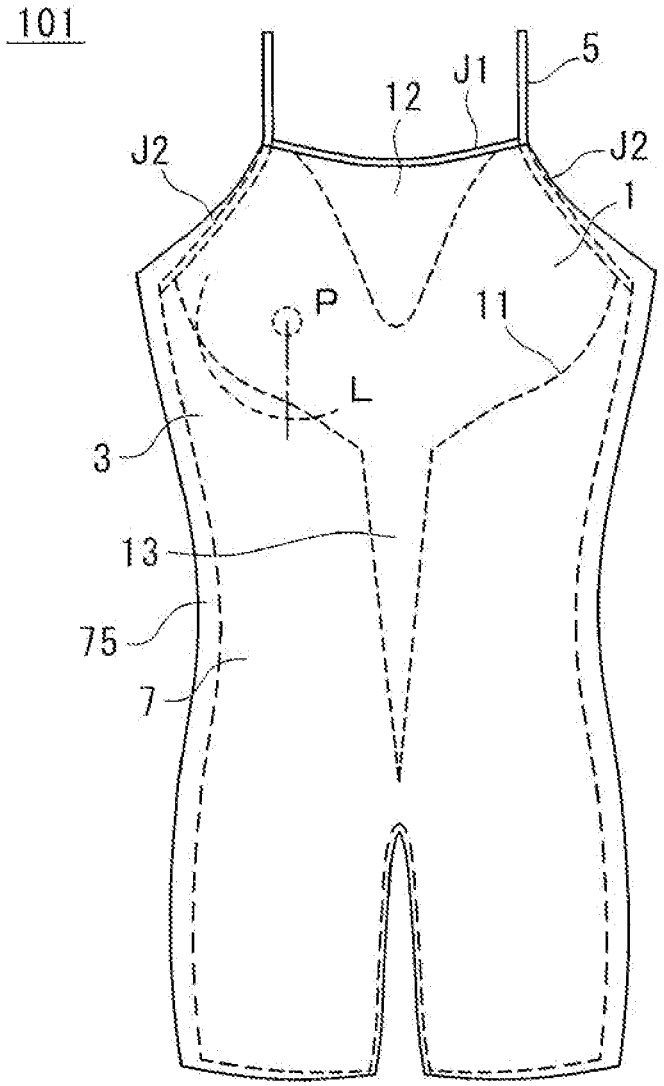
FIG. 38 is a front view illustrating the clothes according to a still other modification embodiment.

FIG. 38 is a front view illustrating clothes 101 according to a still other modification example. The clothes 101 according to the other modification example has a configuration in which the surface-covering portion 75 is arranged to cover the surface of the clothes 101 described based on FIG. 32. The surface-covering portion 75 is connected to the neckline portion J1, the armhole portion J2 and the like. The surface-covering portion 75 may partially be connected to the neckline portion J1 and the armhole portion J2. The surface-covering portion 75 may be connected to the clothes 101 at the other portion except the neckline portion J1 and the armhole portion J2. The dimension in the lengthwise direction of the body-covering portion 7 and the surface-covering portion 75 may be short or long. For example, the body-covering portion 7 and the surface-covering portion 75 may extend to the waist or the leg, and the clothes 101 may be one-piece dress or jumpsuit type pants.

Figure 39:
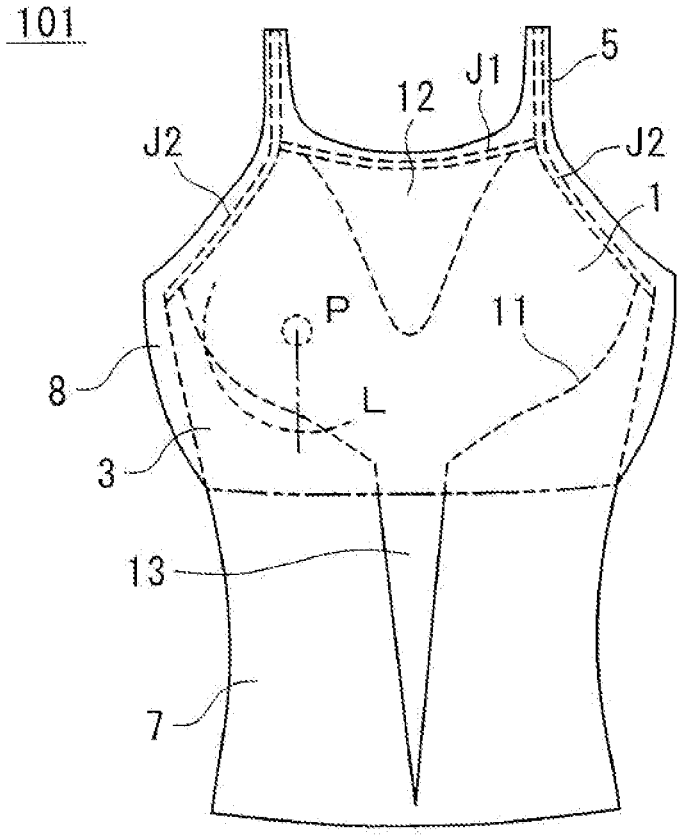
FIG. 39 is a front view illustrating the clothes according to a still other modification embodiment.

FIG. 39 is a front view illustrating clothes 101 according to a still other modification example. The clothes 101 according to the other modification example has a configuration in which the chest-covering portion 8 is arranged to cover the surface of the chest portion of the clothes 101 described based on FIG. 32. The chest-covering portion 8 covers the surface of the shoulder strap portion 5, the breast support portion 1, the body-side support portion 3 and the back support portion 4. The chest-covering portion 8 extends to the position higher than the lower edge of the body-covering portion 7.

The chest-covering portion 8 is connected to the shoulder strap portion 5, the neckline portion J1, the armhole portion J2 and the like. The chest-covering portion 8 may partially be connected to the shoulder strap portion 5, the neckline portion J1 and the armhole portion J2. The chest-covering portion 8 may be connected to the clothes 101 at the other portion except the shoulder strap portion 5, the neckline portion J1 and the armhole portion J2. The bottom portion of the lower edge of the chest-covering portion 8 may be connected to the clothes 101 at the seam described by the two-dot line. The dimension in the lengthwise direction of the body-covering portion 7 may be short or long. For example, the body-covering portion 7 may extend to the waist or the leg, and the clothes 101 may be one-piece dress or jumpsuit type pants.

The chest-covering portion 8 may be provided in the clothes 101 described based on in FIGS. 31, 33, 34 and 35 each.

Next, characteristics of the brassiere 100 according to each of the first embodiment, the second embodiment, and the respective modification examples will be described.

The brassiere 100 includes the breast support portion 1 arranged at the chest of the wearer, the belt portion 2 arranged from the lower side of the breast support portion 1 to the back portion, and the body-side support portion 3 connected to the lateral end 11 of the breast support portion 1 and arranged from the body side to the back portion. The stretching property of the body-side support portion 3 in the lengthwise direction is higher than that in the circumferential direction. Accordingly, when the wearer performs an arm raising movement, the body-side support portion stretches in the lengthwise direction, and the brassiere 100 can reduce inhibition of stretch of the skin on the body side.

Also, the lateral end 11 of the breast support portion 1 is formed along the verge line. Accordingly, the brassiere 100 can improve the holding property of the breasts.

Also, the difference in the stretching property in the circumferential direction between the body-side support portion 3 and the belt portion 2 is smaller than the difference in the stretching property in the lengthwise direction. That is, in the circumferential direction, the stretching properties of both the body-side support portion 3 and the belt portion 2 are lower than those in the lengthwise direction. Accordingly, the brassiere 100 can improve the holding property of the breasts in the circumferential direction.

Also, the body-side support portion 3 includes the lower support portion 31 formed along the belt portion 2 and the upper support portion 32 formed on the upper side of the lower support portion 31. The stretching property of the upper support portion 32 in the lengthwise direction is higher than that of the lower support portion 31. Accordingly, in the brassiere 100, due to the lower support portion 31 having a low stretching property in the lengthwise direction, connection on the body side between the lateral end 11 of the breast support portion 1 and the belt portion 2 can be heightened, and shape stability of the brassiere 100 can be maintained.

Also, the body-side support portion 3 is provided at the upper support portion 32 with the plurality of openings 32*a* which are wide in the circumferential direction. Accordingly, due to the plurality of openings 32*a* which are wide in the circumferential direction, the brassiere 100 can heighten the stretching property of the body-side support portion 3 in the lengthwise direction.

The brassiere 100 also includes the back support portion 4 arranged at the back of the wearer and the shoulder strap portion 5 connecting the upper ends of the breast support portion 1 and the back support portion 4. The stretching properties of the back support portion 4 and the shoulder strap portion 5 in the lengthwise direction are lower than that of the body-side support portion 3. The back support portion 4 is provided so that the lower end thereof may be connected to the belt portion 2 or so that the lower end thereof may extend to the periphery of the belt portion 2. Accordingly, the brassiere 100 can further improve the holding property of the breasts in the lengthwise direction by means of the breast support portion 1, the belt portion 2, the back support portion 4, and the shoulder strap portion 5.

Also, the stretching property of the belt portion 2 in the circumferential direction is lower than those of the breast support portion 1, the body-side support portion 3, and the back support portion 4 in the circumferential direction. Accordingly, the belt portion 2 is firmly secured to the underbust of the wearer, and the brassiere 100 can improve the holding property of the breasts in the circumferential direction.

Also, the breast support portion 1 has at least two fabrics having different stretching properties overlapping. Accordingly, due to overlapping of two fabrics in the breast support portion 1, the brassiere 100 can lower the stretching property to heighten the holding property of the breasts, can prevent the breasts from being seen through, and can provide pockets for inserting cups.

Also, the brassiere 100 includes the breast support portion 1 arranged at the chest of the wearer, the belt portion 2 arranged from the lower side of the breast support portion 1 to the back portion, and the body-side support portion 3 connected to the lateral end 11 of the breast support portion 1 and arranged from the body side to the back portion. At least a part of the lateral end of the breast support portion 1 is formed inside the verge line, the body-side support portion 3 is provided to the verge line lower side, and the stretching property of the body-side support portion 3 in the lengthwise direction is higher than that of the breast support portion 1. Accordingly, in the brassiere 100, when the wearer performs an arm raising movement, inhibition of stretch in the lengthwise direction of the skin around the verge line, particularly the skin in the region from the lower portion of the breasts inside the verge line to the verge line lower side can be reduced, and in addition, inhibition of stretch of the skin on the body side in the lengthwise direction can further be reduced. The brassiere 100 is suitable for wear for sports such as swimming particularly requiring a vigorous arm raising movement.

Also, at least a part of the lateral end 11 of the breast support portion 1 is formed inside the verge line lower outer portion. Accordingly, the brassiere 100 can enlarge the region of the body-side support portion 3 around the verge line and at the verge line lower side. Also, at least a part of the lateral end 11 of the breast support portion 1 is formed inside the verge line upper outer portion. Accordingly, the brassiere 100 can enlarge the region of the body-side support portion 3 around the verge line and at the verge line lower side. Also, at least a part of the lateral end 11 of the breast support portion 1 is formed inside the verge line lower inner portion. Accordingly, the brassiere 100 can further enlarge the region of the body-side support portion 3 around the verge line and at the verge line lower side. Also, the area of the body-side support portion 3 covering the inside of the verge line is larger at the verge line upper outer portion than at the verge line lower inner portion and is larger at the verge line lower outer portion than at the verge line upper outer portion. Consequently, in the brassiere 100, the lateral end 11 of the breast support portion 1 can be formed as the inclined line going downward toward the center of the chest.

Also, the stretching property of the body-side support portion 3 in the lengthwise direction is higher than that in the circumferential direction. Accordingly, the brassiere 100 can fit the body trunk of the wearer.

Also, the stretching property of the breast support portion 1 in the lengthwise direction is lower than that in the circumferential direction. Accordingly, the brassiere 100 holds the breasts by means of a tensile force of the breast support portion 1 in the lengthwise direction while holding the breasts softly in the circumferential direction to enable constriction of the breasts to be suppressed.

Also, the stretching property of the body-side support portion 3 in the circumferential direction is lower than that of the breast support portion 1. Accordingly, in the brassiere 100, the stretching property of the body-side support portion 3 in the circumferential direction is low while that in the lengthwise direction is high, and a fitting property with the chest can be heightened. Also, since the stretching property of the body-side support portion 3 in the circumferential direction is lower than the stretching property of the breast support portion 1 in the circumferential direction, the body-side support portion 3, enlarged to reach the lower portion of the breast, lifts the breast from the bottom, and the shape holding property of the breasts can be improved.

The brassiere 100 also includes the back support portion 4 arranged at the back of the wearer and the shoulder strap portion 5 connecting the upper ends of the breast support portion 1 and the back support portion 4. The stretching property of the back support portion 4 in the lengthwise direction is lower than that of the body-side support portion 3. The back support portion 4 is provided so that the lower end thereof may be connected to the belt portion 2 or so that the lower end thereof may extend to the periphery of the belt portion 2. Accordingly, the brassiere 100 can further improve the holding property of the breasts in the lengthwise direction by means of the breast support portion 1, the belt portion 2, the back support portion 4, and the shoulder strap portion 5.

The embodiments of the present invention have been described above. It is to be understood by those skilled in the art that these embodiments are illustrative, that various modifications and alterations are available within the scope of the patent claims of the present invention, and that such modification examples and alterations are within the scope of the patent claims of the present invention. Accordingly, the description and drawings in the present specification shall be treated not in a limited manner but for illustrative purposes.

The present disclosure further includes the brassiere and the clothes stated in the following items.

[Item 1] A brassiere comprising a breast support portion arranged at a chest of a wearer, a belt portion arranged from a lower side of the breast support portion to a back portion, and a body-side support portion connected to a lateral end of the breast support portion and arranged from a body side to the back portion, wherein a stretching property of the body-side support portion in a lengthwise direction is higher than that in a circumferential direction.

[Item 2] The brassiere according to item 1, wherein the lateral end of the breast support portion is formed along a verge line.

[Item 3] The brassiere according to item 1, wherein a difference in the stretching property in the circumferential direction between the body-side support portion and the belt portion is smaller than a difference in the stretching property in the lengthwise direction.

[Item 4] The brassiere according to item 1, wherein the body-side support portion includes a lower support portion formed along the belt portion and an upper support portion formed on an upper side of the lower support portion, and wherein the stretching property of the upper support portion in the lengthwise direction is higher than that of the lower support portion.

[Item 5] The brassiere according to item 1, wherein the body-side support portion is provided with a plurality of openings which are wide in the circumferential direction.

[Item 6] The brassiere according to item 1, comprising a back support portion arranged at a back of the wearer and a shoulder strap portion connecting upper ends of the breast support portion and the back support portion, wherein the stretching properties of the back support portion and the shoulder strap portion in the lengthwise direction are lower than that of the body-side support portion, and wherein the back support portion is provided to cause a lower end thereof to be connected to the belt portion or to cause the lower end thereof to extend to a periphery of the belt portion.

[Item 7] The brassiere according to item 6, wherein the stretching property of the belt portion in the circumferential direction is lower than those of the breast support portion, the body-side support portion, and the back support portion in the circumferential direction.

[Item 8] The brassiere according to item 1, wherein the breast support portion has at least two fabrics having different stretching properties overlapping.

[Item 9] A brassiere comprising a breast support portion arranged at a chest of a wearer, a belt portion arranged from a lower side of the breast support portion to a back portion, and a body-side support portion connected to a lateral end of the breast support portion and arranged from a body side to the back portion, wherein at least a part of the lateral end of the breast support portion is formed inside a verge line, and the body-side support portion is provided to a verge line lower side, and wherein a stretching property of the body-side support portion in a lengthwise direction is higher than that of the breast support portion.

[Item 10] The brassiere according to item 9, wherein at least the part of the lateral end of the breast support portion is formed inside a verge line lower outer portion.

[Item 11] The brassiere according to item 9, wherein at least the part of the lateral end of the breast support portion is formed inside a verge line upper outer portion.

[Item 12] The brassiere according to item 9, wherein at least the part of the lateral end of the breast support portion is formed inside a verge line lower inner portion.

[Item 13] The brassiere according to item 9, wherein an area of the body-side support portion covering an inside of the verge line is larger at the verge line upper outer portion than at the verge line lower inner portion and is larger at the verge line lower outer portion than at the verge line upper outer portion.

[Item 14] The brassiere according to item 9, wherein the stretching property of the body-side support portion in the lengthwise direction is higher than that in a circumferential direction.

[Item 15] The brassiere according to item 9, wherein the stretching property of the breast support portion in the lengthwise direction is lower than that in the circumferential direction.

[Item 16] The brassiere according to item 9, wherein the stretching property of the body-side support portion in the circumferential direction is lower than that of the breast support portion.

[Item 17] The brassiere according to item 9, comprising a back support portion arranged at a back of the wearer and a shoulder strap portion connecting upper ends of the breast support portion and the back support portion, wherein the stretching property of the back support portion in the lengthwise direction is lower than that of the body-side support portion, and wherein the back support portion is provided to cause a lower end thereof to be connected to the belt portion or to cause the lower end thereof to extend to a periphery of the belt portion.

[Item 18] A brassiere comprising a breast support portion arranged at a chest of a wearer, and a body-side support portion connected to a lateral end of the breast support portion and arranged from a body side to the back portion, wherein the body-side support portion includes a lower support portion having higher stretching property in a lengthwise direction than that of in a circumferential direction, and an upper support portion formed on an upper side of the lower support portion, and wherein the stretching property of the upper support portion in the lengthwise direction is higher than those of the breast support portion and the lower support portion.

[Item 19] The brassiere according to item 18, wherein the lateral end of the breast support portion is formed along a verge line.

[Item 20] The brassiere according to item 18, comprising a back support portion arranged at a back of the wearer, wherein at the back side, the back support portion is provided between the body-side support portion and is lower in the stretching property in the lengthwise direction than the body-side support portion.

[Item 21] The brassiere according to item 18, wherein the breast support portion is formed separately on the left and the right side of a center on the front side of the chest, and wherein a front-side connecting portion is arranged to be connected to the breast support portion at both sides thereof in the center on the front side of the chest.

[Item 22] The brassiere according to item 18, wherein at the upper center portion of the breast support portion, a material is arranged at a region circled by an inclined line going downward as the line approaches the center, and wherein a stretching property of the material in the lengthwise direction is higher than that of the breast support portion.

[Item 23] The brassiere according to item 18, wherein the breast support portion has at least two fabrics having different stretching properties overlapping.

[Item 24] A brassiere comprising a breast support portion arranged at a chest of a wearer, and a body-side support portion connected to a lateral end of the breast support portion and arranged from a body side to the back portion, wherein a stretching property of the body-side support portion in a lengthwise direction is higher than that in a circumferential direction, and wherein the body-side support portion is provided with a plurality of openings which are wider in the circumferential direction than in the lengthwise direction.

[Item 25] The brassiere according to item 24, wherein the lateral end of the breast support portion is formed along a verge line.

[Item 26] The brassiere according to item 24, comprising a back support portion arranged at a back of the wearer, wherein at the back side, the back support portion is provided between the body-side support portion and is lower in the stretching property in the lengthwise direction than the body-side support portion.

[Item 27] The brassiere according to item 24, wherein the breast support portion is formed separately on the left and the right side of a center on the front side of the chest, and wherein a front-side connecting portion is arranged to be connected to the breast support portion at both sides thereof in the center on the front side of the chest.

[Item 28] The brassiere according to claim 24, wherein at the upper center portion of the breast support portion, a material is arranged at a region circled by an inclined line going downward as the line approaches the center, and wherein a stretching property of the material in the lengthwise direction is higher than that of the breast support portion.

[Item 29] The brassiere according to claim 24, wherein the breast support portion has at least two fabrics having different stretching properties overlapping.

[Item 30] A brassiere comprising a breast support portion arranged at a chest of a wearer, and a body-side support portion connected to a lateral end of the breast support portion and arranged from a body side to the back portion, wherein at least a part of the lateral end of the breast support portion is formed inside a verge line, and the body-side support portion is provided to a verge line lower side, and wherein a stretching property of the body-side support portion in a lengthwise direction is higher than that of the breast support portion.

[Item 31] The brassiere according to item 30, wherein at least the part of the lateral end of the breast support portion is formed inside a verge line lower outer portion.

[Item 32] The brassiere according to item 30, wherein at least the part of the lateral end of the breast support portion is formed inside a verge line upper outer portion.

[Item 33] The brassiere according to item 30, wherein at least the part of the lateral end of the breast support portion is formed inside a verge line lower inner portion.

[Item 34] The brassiere according to item 30, wherein an area of the body-side support portion covering an inside of the verge line is larger at the verge line upper outer portion than at the verge line lower inner portion and is larger at the verge line lower outer portion than at the verge line upper outer portion.

[Item 35] The brassiere according to item 30, wherein the stretching property of the body-side support portion in the lengthwise direction is higher than that in a circumferential direction.

[Item 36] The brassiere according to item 30, wherein the stretching property of the breast support portion in the lengthwise direction is lower than that in the circumferential direction.

[Item 37] The brassiere according to item 30, wherein the stretching property of the body-side support portion in the circumferential direction is lower than that of the breast support portion.

[Item 38] The brassiere according to item 18, wherein the lower support portion extends to the front side of the chest and is connected to the lower portion of the breast support portion.

[Item 39] The brassiere according to item 18, comprising a back support portion arranged at a back of the wearer, wherein at the back side, the back support portion extends to a bottom edge between the body-side support portion and is lower in the stretching property in the lengthwise direction than the body-side support portion.

[Item 40] Clothes comprising a breast support portion arranged at a chest of a wearer, a body-side support portion connected to a lateral end of the breast support portion and arranged from a body side to the back portion, and a body-covering portion covering a body on a lower side of the chest of the wearer, wherein the body-side support portion includes a lower support portion having higher stretching property in a lengthwise direction than that of in a circumferential direction, and an upper support portion formed on an upper side of the lower support portion, and wherein the stretching property of the upper support portion in the lengthwise direction is higher than those of the breast support portion and the lower support portion.

[Item 41] The clothes according to item 40, wherein the lower support portion extends to the center of the front side of the chest and is connected to the lower portion of the breast support portion.

[Item 42] The clothes according to item 41, wherein the body-covering portion is formed by an extended portion of the lower support portion to the lower side.

[Item 43] The clothes according to item 40, further comprising a belt portion arranged from a lower side of the breast support portion to a back portion, wherein the body-covering portion is connected to the lower side of the belt portion.

[Item 44] The clothes according to item 40, wherein the body-covering portion is extended to the chest and covers the breast support portion.

[Item 45] The clothes according to item 40, further comprising a chest-covering portion covering the surface of the breast support portion.

[Item 46] The brassiere according to item 30, wherein the lower support portion extends to the center of the front side of the chest and is connected to the lower portion of the breast support portion.

[Item 47] Clothes comprising a breast support portion arranged at a chest of a wearer, a body-side support portion connected to a lateral end of the breast support portion and arranged from a body side to the back portion, and a body-covering portion covering a body on a lower side of the chest of the wearer, wherein at least a part of the lateral end of the breast support portion is formed inside a verge line, and the body-side support portion is provided to a verge line lower side, and wherein a stretching property of the body-side support portion in a lengthwise direction is higher than that of the breast support portion.

[Item 48] The clothes according to item 47, wherein the body-side support portion extends to the center of the front side of the chest and is connected to the lower portion of the breast support portion.

[Item 49] The clothes according to item 48, wherein the body-covering portion is formed by an extended portion of the lower support portion to the lower side.

[Item 50] The clothes according to item 47, wherein the breast support portion includes a front-center support portion extending to a waist in a center of a front side of the wearer.

[Item 51] The clothes according to item 47, further comprising a belt portion arranged from a lower side of the breast support portion to a back portion, wherein the body-covering portion is connected to the lower side of the belt portion.

[Item 52] The clothes according to item 47, wherein the body-covering portion is extended to the chest and covers the breast support portion.

[Item 53] The clothes according to item 47, further comprising a chest-covering portion covering the surface of the breast support portion.

The invention claimed is:

1. A brassiere comprising:

a breast support portion configured to be arranged at a chest of a wearer;

a belt portion connected to a lower side of the breast support portion, the belt portion extending in a circumferential direction so that the belt portion is configured to be arranged from the chest of the wearer along a first side body of the wearer and a back of the wearer to a second side body of the wearer;

a first body-side support portion connected to a first lateral end of the breast support portion, the body-side support portion extending in the circumferential direction so that the first body-side support portion is configured to be arranged from the first side body of the wearer to the back of the wearer; and a second body-side support portion connected to a second lateral end of the breast support portion, the second body-side support portion extending in the circumferential direction so that the second body-side support portion is configured to be arranged from the second side body of the wearer to the back of the wearer, wherein a degree of stretchability of each of the first and second body-side support portions along a lengthwise direction is higher than a degree of stretchability of each of the first and second body-side support portions along the circumferential direction, wherein the lengthwise direction and the circumferential direction traverse each other, wherein each of the first and second body-side support portions includes a lower support portion formed along the belt portion and an upper support portion formed on an upper side of the lower support portion;

wherein the upper support portion includes a plurality of openings, and wherein a diameter of each of the openings along the circumferential direction is greater than a diameter of each of the openings along the lengthwise direction so that a degree of stretchability of the upper support portion in the lengthwise direction is higher than a degree of stretchability of the lower support portion in the lengthwise direction.

2. The brassiere according to claim 1, wherein a difference between the degree of stretchability of each of the first and second body-side support portions along the circumferential direction and a degree of stretchability of the belt portion along the circumferential direction is smaller than a difference between the degree of stretchability of each of the first and second body-side support portions along the lengthwise direction and a degree of stretchability of the belt portion along the lengthwise direction.

3. The brassiere according to claim 1, comprising:

a back support portion arranged at the back of the wearer; and a shoulder strap portion connecting an upper end of the breast support portion and an upper end of the back support portion, wherein a degree of stretchability of the back support portion along the lengthwise direction and a degree of stretchability of the shoulder strap portion along the lengthwise direction are lower than the degree of stretchability of each of the first and second body-side support portions along the lengthwise direction, and wherein the back support portion includes a lower end connected to the belt portion or extended to a periphery of the belt portion.

4. The brassiere according to claim 3, wherein a degree of stretchability of the belt portion along the circumferential direction is lower than a degree of stretchability of the breast support portion along the circumferential direction, the degree of stretchability of each of the first and second body-side support portions along the circumferential direction, and a degree of stretchability of the back support portion along the circumferential direction.

5. The brassiere according to claim 1, wherein the breast support portion has at least two fabrics overlapping one another, and wherein the at least two fabrics have different degrees of stretchability from one another.

6. A brassiere comprising:

a breast support portion configured to be arranged at a chest of a wearer;

a back support portion configured to be arranged at a back of the wearer;

a belt portion connected to a lower side of the breast support portion, the belt portion extending in a circumferential direction so that the belt portion is configured to be arranged from the chest of the wearer along a first side body of the wearer to the back of the wearer to a second side body of the wearer;

a first body-side support portion connected to a first lateral end of the breast support portion and a first end of the back support portion to extend between the breast support portion and the back support portion in the circumferential direction so that the first body-side support portion is configured to be arranged from the first side body of the wearer to the back of the wearer; and a second body-sided support portion connected to a second lateral end of the breast support portion and a second end of the back support portion to extend between the breast support portion and the back support portion in the circumferential direction so that the second body-side support portion is configured to be arranged from the second side body of the wearer to the back of the wearer, wherein at least a part of the first lateral end of the breast support portion is configured to be formed inside a verge line of the wearer when worn by the wearer, and the first body-side support portion is provided to a verge line lower side, wherein a degree of stretchability of each of the first and second body-side support portions in a lengthwise direction is higher than a degree of stretchability of the breast support portion in the lengthwise direction, wherein the lengthwise direction and the circumferential direction traverse each other, wherein each of the first and second body-side support portions includes i) a lower support portion formed along the belt portion and ii) an upper support portion formed on an upper side of the lower support portion, wherein the upper support portion includes a plurality of openings, and wherein a diameter of each of the openings along the circumferential direction is greater than a diameter of each of the openings along the lengthwise direction so that a degree of stretchability of the upper support portion in the lengthwise direction is higher than a degree of stretchability of the lower support portion in the lengthwise direction.

7. A brassiere comprising:

a breast support portion configured to be arranged at a chest of a wearer;

a back support portion configured to be arranged at the back of the wearer;

a first body-side support portion connected to a first lateral end of the breast support portion and a first end of the back support portion to extend between the breast support portion and the back support portion in a circumferential direction so that the first body-side support portion is configured to be arranged from a first side body of the wearer to a back of the wearer; and a second body-sided support portion connected to a second lateral end of the breast support portion and a second end of the back support portion to extend between the breast support portion and the back support portion in the circumferential direction so that the second body-side support portion is configured to be arranged from the second side body of the wearer to the back of the wearer, wherein each of the first and second body-side support portions includes a lower support portion and an upper support portion formed on an upper side of the lower support portion, wherein the lower support portion has a higher degree of stretchability along a lengthwise direction than along the circumferential direction, wherein the upper support portion includes a plurality of openings, wherein a diameter of each of the openings along the circumferential direction is greater than a diameter of each of the openings along the lengthwise direction so that a degree of stretchability of the upper support portion in the lengthwise direction is higher than a degree of stretchability of the lower support portion in the lengthwise direction, wherein a degree of stretchability of the upper support portion along the lengthwise direction is higher than a degree of stretchability of the breast support portion along the lengthwise direction and a degree of stretchability of the lower support portion along the lengthwise direction, and wherein the lengthwise direction and the circumferential direction traverse each other.

8. The brassiere according to claim 7, wherein the back support portion extends in the circumferential direction between the first body-side support portion and the second body-side support portion, and wherein a degree of stretchability of the back support portion along the lengthwise direction is lower than a degree of stretchability of the first and second body-side support portions along the lengthwise direction.

9. The brassiere according to claim 7, wherein the breast support portion has at least two fabrics overlapping one another, and wherein the at least two fabrics have different degrees of stretchability from one another.

10. The brassiere according to claim 7, wherein the back support portion extends in the circumferential direction between the first body-side support portion and the second body-side support portion and extends in the lengthwise direction to a bottom edge of the brassiere, and wherein a degree of stretchability of the back support portion along the lengthwise direction is lower than a degree of stretchability of the first and second body-side support portions along the lengthwise direction.

11. A brassiere comprising:

a breast support portion configured to be arranged at a chest of a wearer;

a back support portion configured to be arranged at the back of the wearer;

a first body-side support portion connected to a first lateral end of the breast support portion and a first end of the back support portion to extend between the breast support portion and the back support portion in a circumferential direction so that the first body-side support portion is configured to be arranged from a first side body of the wearer to a back of the wearer; and a second body-sided support portion connected to a second lateral end of the breast support portion and a second end of the back support portion to extend between the breast support portion and the back support portion in the circumferential direction so that the second body-side support portion is configured to be arranged from the second side body of the wearer to the back of the wearer, wherein a degree of stretchability of each of the first and second body-side support portions along a lengthwise direction is higher than a degree of stretchability of each of the first and second body-side support portions along the circumferential direction, wherein the lengthwise direction and the circumferential direction traverse each other, wherein each of the first and second body-side support portions includes i) a lower support portion and ii) an upper support portion formed on an upper side of the lower support portion, wherein the upper support portion includes a plurality of openings, wherein a diameter of each of the openings along the circumferential direction is greater than a diameter of each of the openings along the lengthwise direction so that a degree of stretchability of the upper support portion in the lengthwise direction is higher than a degree of stretchability of the lower support portion in the lengthwise direction.

12. The brassiere according to claim 11, wherein the back support portion extends in the circumferential direction between the first body-side support portion and the second body-side support portion, and wherein a degree of stretchability of the back support portion along the lengthwise direction is lower than the degree of stretchability of each of the first and second body-side support portions along the lengthwise direction.

13. The brassiere according to claim 11, wherein the breast support portion has at least two fabrics overlapping one another, and wherein the at least two fabrics have different degrees of stretchability from one another.

* * * * *